US009942638B2

(12) United States Patent
Takahashi et al.

(10) Patent No.: US 9,942,638 B2
(45) Date of Patent: Apr. 10, 2018

(54) COMPOSITE ELECTRONIC DEVICE, SPEAKER CARTRIDGE, AND ELECTRONIC DEVICE

(71) Applicant: KYOCERA Corporation, Kyoto-shi, Kyoto (JP)

(72) Inventors: Tooru Takahashi, Kyoto (JP); Shuichi Fukuoka, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 15/112,860

(22) PCT Filed: Jan. 30, 2015

(86) PCT No.: PCT/JP2015/052715

§ 371 (c)(1),
(2) Date: Jul. 20, 2016

(87) PCT Pub. No.: WO2015/115608

PCT Pub. Date: Aug. 6, 2015

(65) Prior Publication Data

US 2016/0345085 A1 Nov. 24, 2016

(30) Foreign Application Priority Data

Jan. 30, 2014 (JP) ..... 2014-015701

(51) Int. Cl.
*H04R 1/02* (2006.01)
*H04R 31/00* (2006.01)
(Continued)

(52) U.S. Cl.
CPC ..... *H04R 1/026* (2013.01); *H04R 1/288* (2013.01); *H04R 17/00* (2013.01); *H04R 17/005* (2013.01); *H04R 31/00* (2013.01); *H04R 31/006* (2013.01)

(58) Field of Classification Search
CPC ..... H04R 17/00
See application file for complete search history.

(56) References Cited

U.S. PATENT DOCUMENTS

2015/0003642 A1* 1/2015 Nakamura ..... H04R 17/00 381/162

FOREIGN PATENT DOCUMENTS

JP 60-061897 U 4/1985
JP 07-295600 A 11/1995
(Continued)

OTHER PUBLICATIONS

International Search Report, PCT/JP2015/052715, dated Apr. 28, 2015, 2 pgs.

*Primary Examiner* — Matthew Eason
*Assistant Examiner* — Phan Le
(74) *Attorney, Agent, or Firm* — Volpe and Koenig, P.C.

(57) ABSTRACT

A composite electronic device includes an electronic device; and a speaker cartridge. The speaker cartridge includes a vibration body, an exciter, a first housing, and a first connector. The vibration body has a first main surface and a second main surface. A first space is defined by the first main surface and the first housing, and a second space is defined by the second main surface and the first housing. The electronic device includes an electronic circuit, a second housing, and a second connector. A third space surrounded by the second housing is provided. The exciter and the electronic circuit are electrically connected to each other. The first space is in communication with an outer space via a first opening of the first housing. The second space is in communication with the third space via a second opening of the first housing.

7 Claims, 21 Drawing Sheets

(51) Int. Cl.

| | |
|---|---|
| ***H04R 17/00*** | (2006.01) |
| ***H04R 1/28*** | (2006.01) |
| ***H04R 1/26*** | (2006.01) |

(56) References Cited

FOREIGN PATENT DOCUMENTS

| | | | | |
|---|---|---|---|---|
| JP | 07295600 | A | * | 11/1995 |
| JP | 2005-222437 | A | | 8/2005 |
| JP | 2013-192175 | A | | 9/2013 |

* cited by examiner

COMPOSITE ELECTRONIC DEVICE, SPEAKER CARTRIDGE, AND ELECTRONIC DEVICE

TECHNICAL FIELD

The present invention relates to a composite electronic device, a speaker cartridge, and an electronic device.

BACKGROUND ART

In the related art, there is known an electronic device in which a speaker, which generates a sound by vibrating a vibration plate attached to a piezoelectric element, is mounted inside a housing (for example, refer to Patent Literature 1).

CITATION LIST

Patent Literature

Patent Literature 1: Japanese Unexamined Patent Publication JP-A 2013-192175

SUMMARY OF INVENTION

Technical Problem

The vibration plate is disposed inside and is surrounded by the housing of the electric device. Accordingly, a sound generated by the vibration plate is reflected inside the housing of the electronic device, thereby leading to the occurrence of resonance. As a result, the quality of a sound radiating to the outside of the electronic device is considerably affected by a complicated internal structure of the housing of the electronic device. As a result, in order to improve the quality of a sound generated by the electronic device, it is necessary to implement sound design in the housing of the electronic device which is complicated and has a low degree of design freedom, which is a considerably difficult task.

The invention is devised in light of this problem with the technology in the related art, and an object thereof is to provide a composite electronic device capable of easily generating a high-quality sound, and a speaker cartridge and an electronic device which are used therein.

Solution to Problem

According to one embodiment of the invention, a composite electronic device includes: an electronic device; and a speaker cartridge detachably connected to the electronic device, the speaker cartridge including a vibration body, an exciter attached to the vibration body, a first housing which surrounds and accommodates the vibration body therein, and a first connector electrically connected to the exciter, the vibration body having a first main surface and a second main surface which are opposite to each other, the speaker cartridge being provided with a first space surrounded by the first main surface of the vibration body and the first housing, and a second space surrounded by the second main surface of the vibration body and the first housing, the electronic device including an electronic circuit, a second connector connected to the electronic circuit, and a second housing, the second housing being provided with a third space formed therein, the first connector being connected to the second connector, the exciter being electrically connected to the electronic circuit, a portion of the first housing adjacent to the first space being provided with a first opening, the first space being in communication with an outer space via the first opening, a portion of the first housing adjacent to the second space being provided with a second opening, the second space being in communication with the third space via the second opening.

According to another embodiment of the invention, a speaker cartridge includes: a vibration body; an exciter attached to the vibration body; a first housing which surrounds and accommodates the vibration body therein; and a first connector electrically connected to the exciter, the vibration body having a first main surface and a second main surface which are opposite to each other, the speaker cartridge being provided a first space surrounded by the first main surface of the vibration body and the first housing, a second space surrounded by the second main surface of the vibration body and the first housing, a first opening located in a portion of the first housing adjacent to the first space, and a second opening located in a portion of the first housing adjacent to the second space.

According to still another embodiment of the invention, an electronic device includes: an electronic circuit; a second connector connected to the electronic circuit; and a second housing, the second housing being provided with a third space formed therein, and a third opening adjacent to the third space.

Advantageous Effects of Invention

A composite electronic device of the invention is capable of easily generating a high-quality sound. It is possible to easily realize a composite electronic device which generates a high-quality sound, via a speaker cartridge of the invention. It is possible to easily realize a composite electronic device which generates a high-quality sound, via an electronic device of the invention.

DESCRIPTION OF EMBODIMENTS

Figure 1:
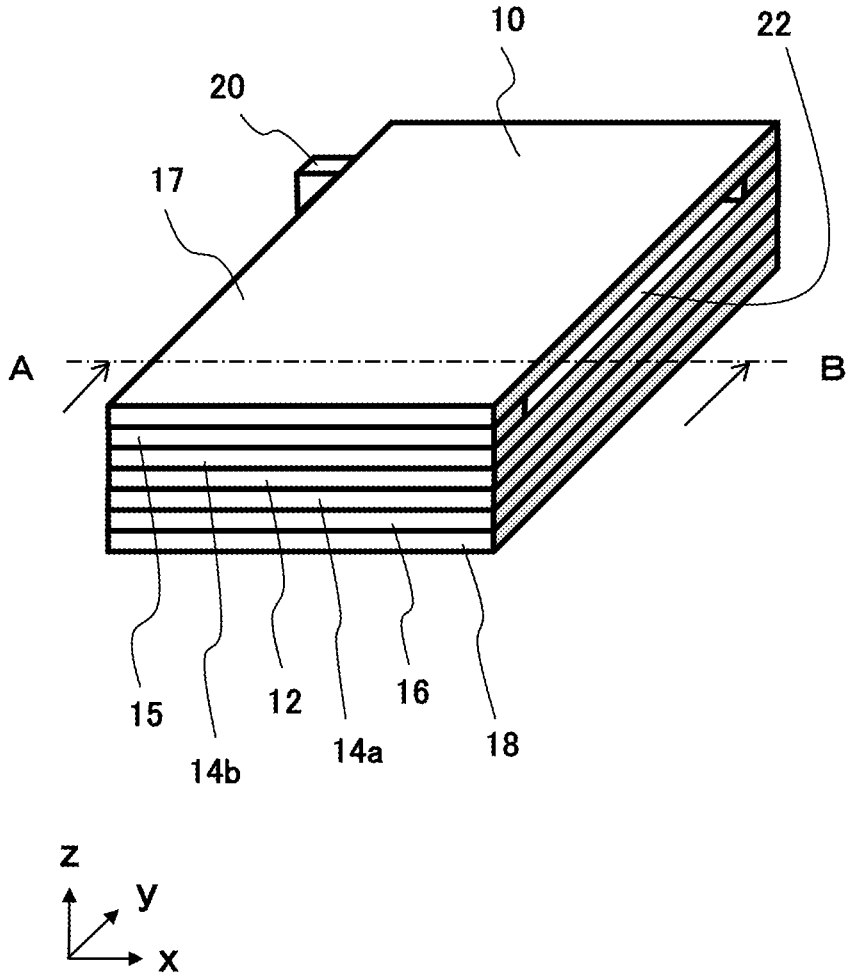
FIG. 1 is a perspective view schematically illustrating a speaker cartridge according to a first embodiment of the invention.

Hereinafter, a composite electronic device, a speaker cartridge, and an electronic device according to embodiments of the invention will be described in detail with reference to the accompanying drawings. In the drawings, directions are illustrated by an x-axis, a y-axis, and a z-axis which are perpendicular to each other.

First Embodiment

Figure 2:
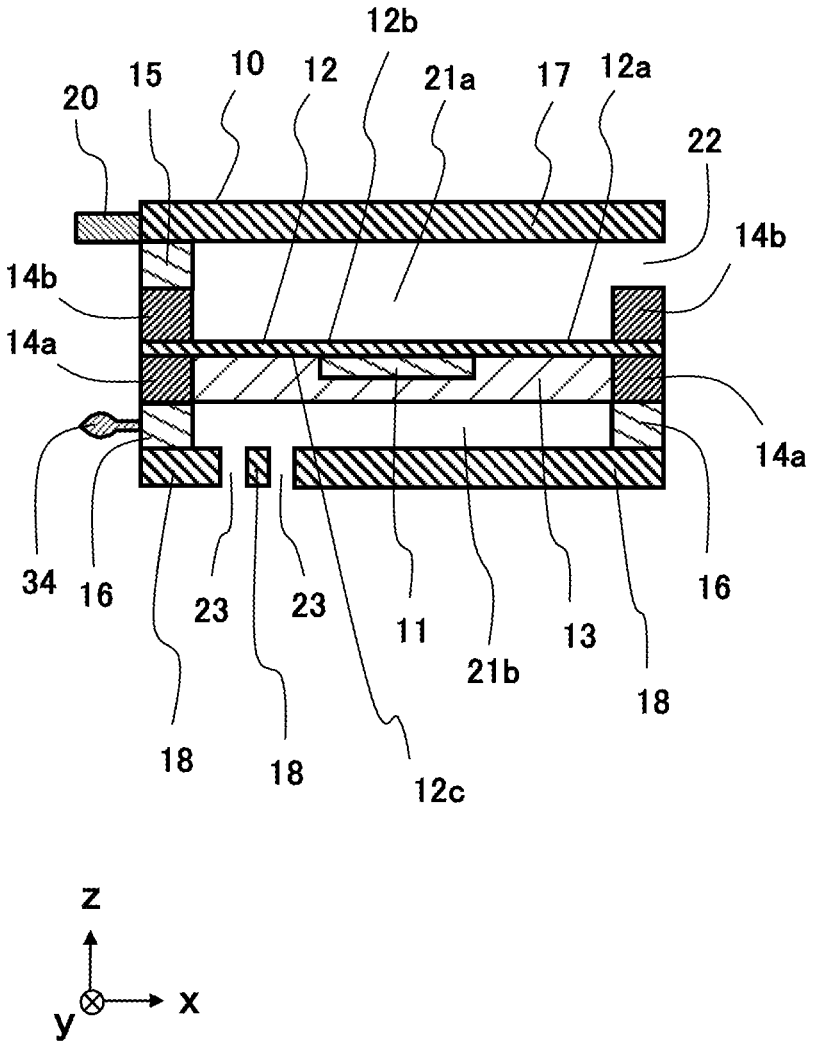
FIG. 2 is a sectional view taken along the line A-B in FIG. 1.
Figure 3:
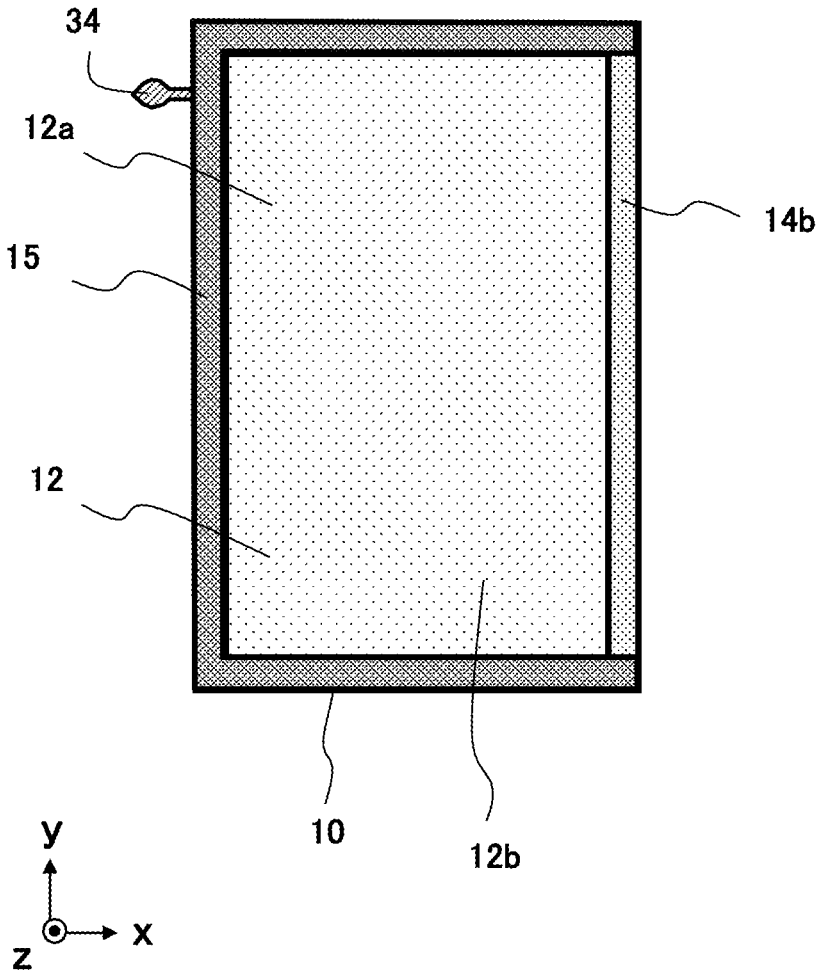
FIG. 3 is a top view schematically illustrating a state where a panel 17 has been removed from the speaker cartridge according to the first embodiment of the invention, when viewed from a +z direction side.
Figure 4:
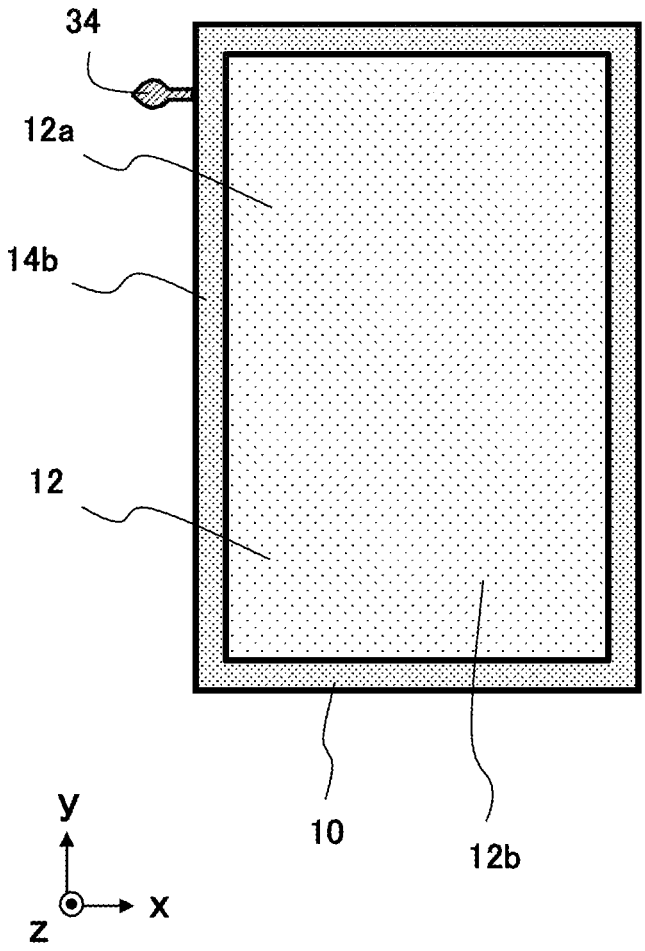
FIG. 4 is a top view schematically illustrating a state where a panel 17 and a spacer 15 have been removed from the speaker cartridge according to the first embodiment of the invention, when viewed from a +z direction side.
Figure 5:
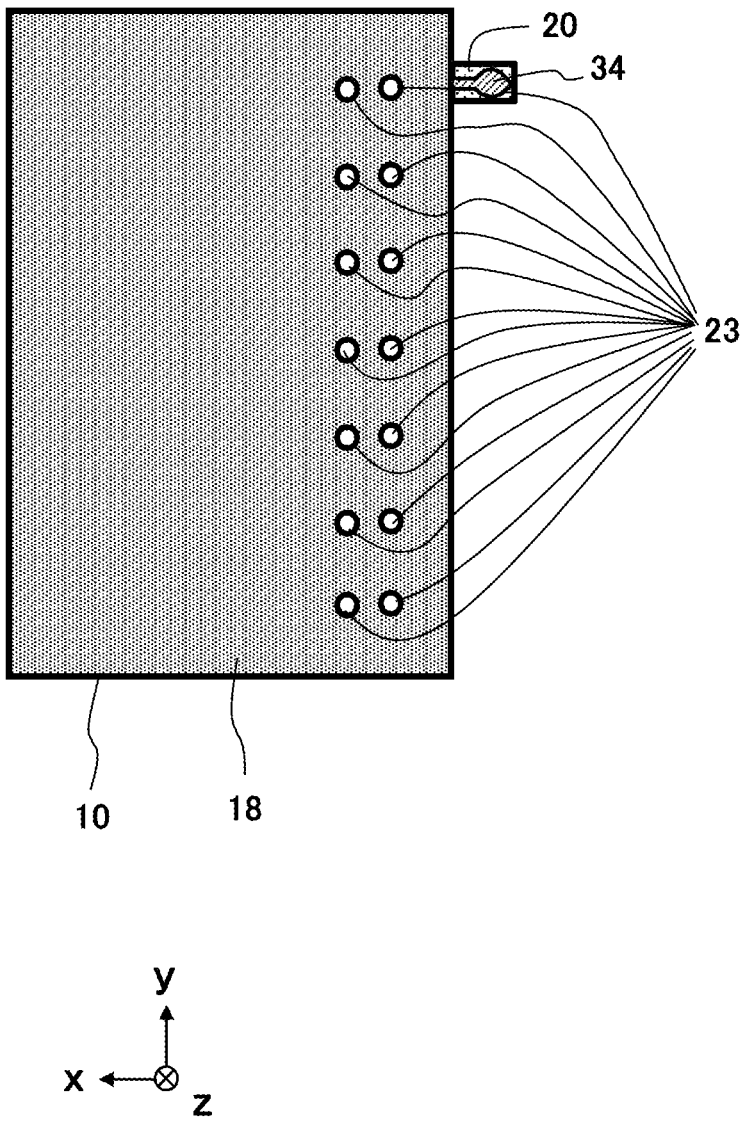
FIG. 5 is a top view schematically illustrating a speaker cartridge according to the first embodiment of the invention, when viewed from a −z direction side.
Figure 6:
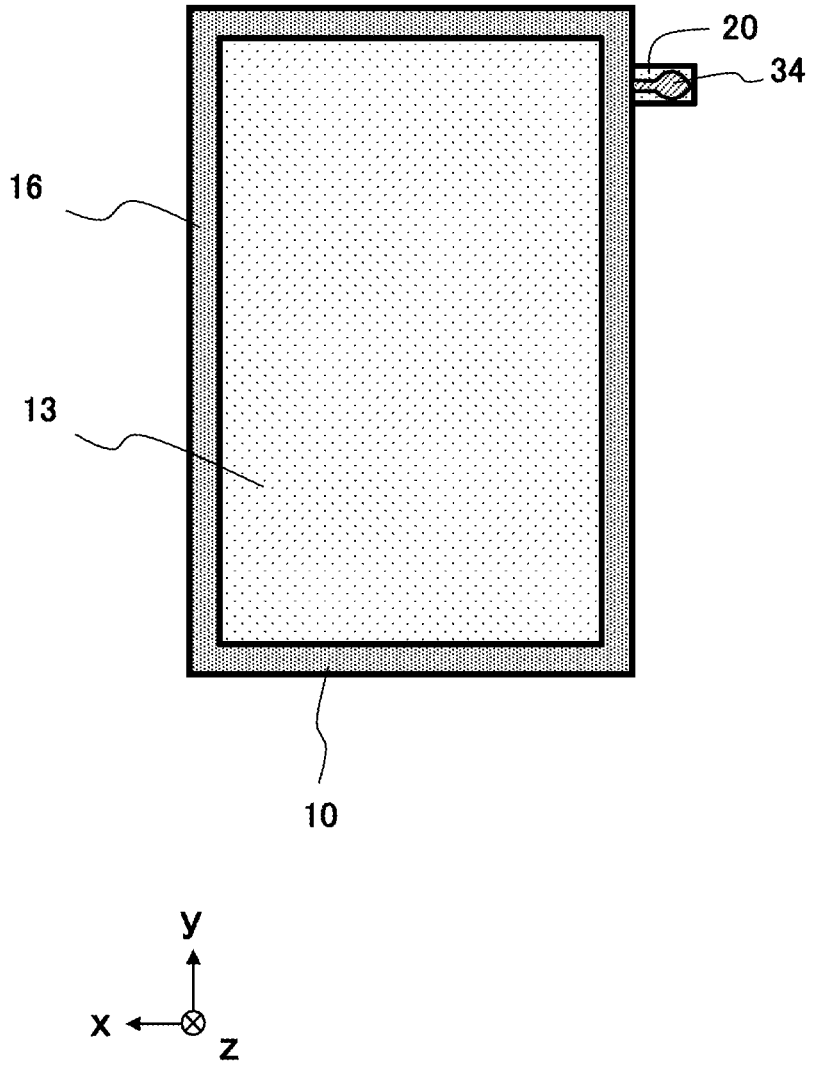
FIG. 6 is a top view schematically illustrating a state where a panel 18 has been removed from the speaker cartridge according to the first embodiment of the invention, when viewed from a −z direction side.
Figure 7:
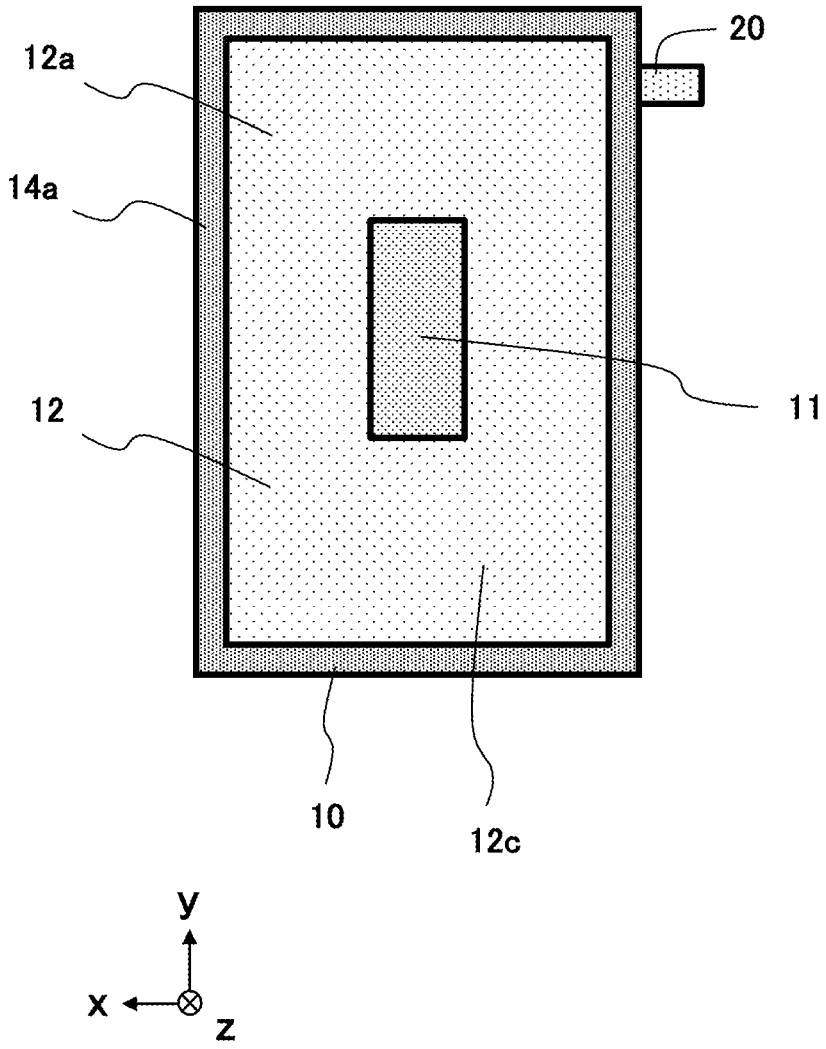
FIG. 7 is a top view schematically illustrating a state where a panel 18, a spacer 16, and a resin layer 13 have been removed from the speaker cartridge according to the first embodiment of the invention, when viewed from a −z direction side.

FIG. 1 is a perspective view schematically illustrating a speaker cartridge according to a first embodiment of the invention. FIG. 2 is a sectional view taken along the line A-B in FIG. 1. FIGS. 3 and 4 are top views schematically illustrating the speaker cartridge according to the first embodiment of the invention, when viewed from a +z direction side. FIG. 3 illustrates a state where a panel 17 has been removed from the speaker cartridge, and FIG. 4 illustrates a state where the panel 17 and a spacer 15 have been removed from the speaker cartridge. FIGS. 5 to 7 are top views schematically illustrating the speaker cartridge according to the first embodiment of the invention, when viewed from a −z direction side. FIG. 6 illustrates a state where a panel 18 has been removed from the speaker cartridge, and FIG. 7 illustrates a state where the panel 18, a spacer 16, and a resin layer 13 have been removed from the speaker cartridge.

As illustrated in FIGS. 1 to 7, the speaker cartridge according to the embodiment includes an exciter 11; a film 12; the resin layer 13; frames 14*a* and 14*b*; the spacers 15 and 16; the panels 17 and 18; and a first connector 20.

Each of the frames 14*a* and 14*b* has a rectangular frame-like shape. For example, stainless frames having a thickness of 100 to 1000 μm may be suitably used as the frames 14*a* and 14*b*; however, the frames 14*a* and 14*b* are not limited to a specific material and a specific thickness, and any type of material and any dimension of thickness may be adopted insofar as the frames 14*a* and 14*b* are more unlikely to be deformed than the film 12 and the resin layer 13. The frames 14*a* and 14*b* may be formed of rigid resin, plastics, engineering plastics, ceramics, or the like.

The film 12 has a film-like (thin plate-like) shape, and may be formed of resin such as polyethylene terephthalate (PET) or polyimide. For example, the thickness of the film 12 is 10 to 200 μm. The film 12 is fixed while circumferential edge portions of upper and lower main surfaces (both end surfaces in a z-axis direction) of the film 12 are interposed between the frames 14*a* and 14*b* in a state where tension is applied to the film 12 in a planar direction (in an x-axis direction and a y-axis direction). The film 12 is vibratably supported by the frames 14*a* and 14*b*. A vibration body 12*a*, which can be freely vibrated, is composed of a portion of the film 12 which is positioned inside of the frames 14*a* and 14*b* and is not interposed between the frames 14*a* and 14*b*. That is, the vibration body 12*a* has a rectangular flat plate-like (film-like) shape. The vibration body 12*a* has a first main surface 12*b* which is a surface on the +z direction side, and a second main surface 12*c* which is a surface on the −z direction side.

The shape of the frames 14*a* and 14*b* is not limited to a rectangular shape, and may be a circular shape or a rhomboidal shape. In a case where the frame 14*b* is not provided, the film 12 may be joined to a surface on the +z direction side of the frame 14*a*. In a case where the frame 14*a* is not provided, the film 12 may be joined to a surface on the −z direction side of the frame 14*b*. Since the vibration body 12*a* may have a flat shape (thin and wide shape), that is, a thin plate-like shape or a film-like shape, the vibration body 12*a* may be formed of thin plate-like metal, paper, or the like instead of the film 12.

The exciter 11 is attached to the second main surface 12*c* of the vibration body 12*a*, and is integrated with the vibration body 12*a*. The exciter 11 is a piezoelectric element having a plate-like shape, and upper and lower main surfaces (both end surfaces in the z-axis direction) have a rectangular shape. The exciter 11 includes a stacked body in which piezoelectric layers formed of piezoelectric ceramics and inner electrode layers are alternately laminated on top of each other; surface electrode layers which are respectively formed on upper and lower surfaces (both end surfaces in the z-axis direction) of the stacked body; and a pair of terminal electrodes which are provided respectively on both end surfaces in a longitudinal direction (x-axis direction) of the stacked body, which is not illustrated in detail. The surface electrodes and the inner electrode layers are alternately led out to the both end surfaces in the longitudinal direction (x-axis direction) of the stacked body, and are connected to the terminal electrodes. Electric signals are inputted to the pair of terminal electrodes via wirings (not illustrated).

The exciter 11 is a bimorph-type piezoelectric element. When electric signals are inputted to the exciter 11, at any moment, expansion and contraction at one side and the other side in a thickness direction (z-axis direction) of the exciter 11 are reversed. Accordingly, when electric signals are inputted to the exciter 11, the exciter 11 is subjected to flexural vibration in the z-axis direction, and the vibration body 12*a* is vibrated due to vibration of the exciter 11. A sound is generated due to vibration of the vibration body 12*a*.

The exciter 11 may be a monomorph-type vibration element in which a piezoelectric element, which is subjected to stretching vibration when electric signals are inputted thereto, is attached to a metal plate. A film 12 side main surface of the exciter 11 is joined to the film 12 with well-known adhesives such as epoxy-based resin, silicone-based resin, polyester-based resin, double-sided tape, or the like.

The resin layer 13 is formed in the entire range inside of the frame 14*a* so that the exciter 11 is embedded in the resin layer 13, and is integrated with the vibration body 12*a* and the exciter 11. The resin layer 13 may be formed of various known materials. For example, resin such as acrylic resin or silicone resin, rubber, or the like may be used as the material of the resin layer 13. Although the thickness of the resin layer 13 is desirably set to the extent of completely covering the exciter 11 with the resin layer 13, the resin layer 13 may be formed so that at least a portion of the film 12 is covered with the resin layer 13. The resin layer 13 has an effect of improving the quality of a sound generated by the speaker cartridge; however, the resin layer 13 is not essential, and according to circumstances, may not be provided.

The spacer 16 is joined to a surface on the −z direction side of the frame 14*a*. The spacer 16 has the same shape (rectangular frame shape) as that of the frame 14*a*. The spacer 16 has the same dimensions as those of the frame 14*a* except that the dimension of the thickness (dimension in the z-axis direction) of the spacer 16 is larger than that of the frame 14*a*. The spacer 15 is joined to a surface on the +z direction side of the frame 14*b*. The spacer 15 has a shape obtained by removing one side in a +x direction from the same rectangular frame-like shape as that of the frame 14*b*, that is, has the shape of an alphabet "U".

The panel 17 has a rectangular flat plate-like shape, and a circumferential edge of a main surface on the −z direction side thereof is joined to a surface on the +z direction side of the spacer 15. A first space 21*a* is defined by the first main surface 12*b* of the vibration body 12*a*, the frame 14*b*, the spacer 15, and the panel 17. A first opening 22 having a rectangular shape is formed in an end portion on the +x direction side of the first space 21*a*, the first opening 22 being surrounded by the frame 14*b*, the spacer 15, and the panel 17. The first space 21*a* is in communication with an outer space via the first opening 22.

The panel 18 has a rectangular flat plate-like shape, and a circumferential edge of a main surface on the +z direction side thereof is joined to a surface on the −z direction side of the spacer 16. A second space 21*b* is formed by the second main surface 12*c* of the vibration body 12*a*, the frame 14*a*, the spacer 16, and the panel 18. A plurality of through holes 23 are formed in rows in a portion on a −x direction side of the panel 18. The plurality of through holes 23 constitute a second opening connected to the second space 21*b*.

As such, a portion of the film 12 which is interposed between the frames 14*a* and 14*b*, as well as the frames 14*a* and 14*b*, the spacers 15 and 16, and the panels 17 and 18 constitute a first housing 10 which surrounds the vibration body 12*a*. The first housing 10 has a rectangular parallelepiped box-like shape.

The spacers 15 and 16 and the panels 17 and 18 may be formed of various materials such as resin, metal, ceramics, glass, and wood. Since the spacers 15 and 16 and the panels 17 and 18 may form the first space 21*a* and the second space 21*b* together with the vibration body 12*a*, respectively, the spacers and 16 and the panels 17 and 18 are not limited to a rectangular shape, and for example, may have other shapes such as a hexagonal shape and an elliptical shape.

The first connector 20 is attached to an end portion on the −x direction side of the first housing 10. The first connector 20 is connected to the exciter 11 via wirings (not illustrated). When the speaker cartridge is inserted into an electronic device, the first connector 20 is connected to a connector of the electronic device so that the speaker cartridge is electrically connected to the electronic device. The first connector 20 may have a function of electrically connecting the speaker cartridge to the electronic device. Various known connectors may be used as the first connector 20.

A joining portion 34 is provided in the first housing 10. The joining portion 34 is provided in an end portion in the −x direction of the first housing 10. The joining portion 34 has a bar shape such that an end portion in the −x direction of the joining portion 34 is bulged. The joining portion 34 is used to detachably join the first housing 10 to the electronic device.

The speaker cartridge in the embodiment is, for example, inserted into a slot or the like of the electronic device from the −x direction side in which the first connector 20 is provided, so that only a surface on the +x direction side of the first housing 10 is exposed to the outside of the electronic device. As a result, the first opening 22 is exposed to the outside of the electronic device, and the second opening composed of the plurality of through holes 23 is in communication with an inner space of the electronic device. Electric signals are supplied from the electronic device to the exciter 11 via the first connector 20 and wirings (not illustrated), the exciter 11 vibrates, the vibration body 12*a* is vibrated via vibration of the exciter 11, and then a sound is generated. A sound generated at a first main surface 12*b* side of the vibration body 12*a* resonates inside the first space 21*a*, and directly radiate to the outside of the electronic device via the first opening 22. An antiphase sound generated at a second main surface 12*c* side of the vibration body 12*a* radiates to the inner space of the electronic device via the second opening composed of the plurality of through holes 23. As a result, a composite electronic device including the speaker cartridge and the electronic device is capable of easily generating a high-quality sound.

In a case where only the vibration body 12*a* is directly disposed inside the electronic device, there is a problem that a sound generated at the first main surface 12*b* side of the vibration body 12*a* and a sound generated at the second main surface 12*c* side of the vibration body 12*a* are mixed together and cancel each other out in the inner space of the electronic device. Since a sound generated by the vibration body 12*a* resonates in the inner space of the electronic device, the inner space of the electronic device becomes a resonance space. Accordingly, sound quality is changed by influences of the shape and material of a housing of the electronic device and the arrangement, shapes, and materials of various components disposed inside the housing of the electronic device. As a result, sound design becomes considerably difficult.

In contrast, since the speaker cartridge according to the embodiment includes the first housing 10 which surrounds the vibration body 12*a* and forms a resonance space, it is possible to implement sound design only with the shape and material of the vibration body 12*a* or the first housing 10 without substantial influence of the shape and material of the housing of the electronic device and the arrangement, shapes, and materials of various components disposed inside the housing of the electronic device. The first housing 10 may have strength relatively lower than that of the housing of the electronic device, and is less limited by factors other than sound design. Accordingly, it is possible to freely set the size, shape, and material of the first housing 10 while taking only sound design into consideration. The first opening 22 through which a space outside of the electronic device is in communication with the first space 21*a*, is formed in the first housing 10, and a high-quality sound which is generated on the first main surface 12*b* side of the vibration body 12*a*, is capable of directly radiating to the space outside of the electronic device via the first opening 22. The position, shape and size of the first opening 22 can be determined via sound design.

It is possible to prevent a sound generated at the first main surface 12*b* side and a sound generated at the second main surface 12*c* side from being mixed together and canceling each other out in the outer space by allowing the sound which is generated at the second main surface 12*c* side of the vibration body 12*a*, to radiate to the inside of the electronic device via the second opening composed of the plurality of through holes 23. In a case where the second opening does not exist, it is necessary to increase the volume of the second space so as to prevent air in the second space from acting as a spring and restricting vibration of the vibration body 12*a*. As a result, there occurs a problem that the size of the speaker cartridge is increased. In a case where the second opening is exposed to the outer space, it is necessary to increase the volume of the second space so as to prevent a sound generated at the first main surface 12*b* side and a sound generated at the second main surface 12*c* side from being mixed together and cancelling each other out in the outer space. As a result, there occurs a problem that the size of the speaker cartridge is increased. It is possible to prevent a sound generated at the first main surface 12*b* side and a sound generated at the second main surface 12*c* side from being mixed together and cancelling each other out in the outer space by allowing the sound which is generated at the second main surface 12*c* side, to radiate to the inside of the electronic device via the second opening. It is possible to prevent an increase in the size of the speaker cartridge. The outer space represents a space outside of the electronic device and the speaker cartridge, and is a space in which a target who listens to a sound is present.

As such, it is possible to easily realize a composite electronic device which generates a high-quality sound, only by inserting a speaker cartridge into a slot of an electronic device and electrically connecting the speaker cartridge to the electronic device. It is possible to easily change the quality of a sound generated by a composite electronic device by preparing a plurality of speaker cartridges in which sound design is differently implemented and differently generate the quality of a sound, and replacing a speaker cartridge with another one thereamong. A composite electronic device refers to a device in which a speaker cartridge is detachably connected to an electronic device. A composite electronic device will be described in detail in fourth to eighth embodiments.

The speaker cartridge according to the embodiment includes the vibration body 12*a*; the exciter 11; the first housing 10; and the first connector 20. The exciter 11 is attached to the vibration body 12*a*. The first housing 10 surrounds and accommodates the vibration body 12*a* therein. The first connector 20 is electrically connected to the exciter 11. The vibration body 12*a* has the first main surface 12*b* and the second main surface 12*c* which are opposite to each other. The speaker cartridge according to the embodiment includes the first space 21*a*; the second space 21*b*; the first opening 22; and the second opening. The first space 21*a* is a space which is surrounded by the first main surface 12*b* of the vibration body 12*a* and the first housing 10. The second space 21*b* is a space which is surrounded by the second main surface 12*c* of the vibration body 12*a* and the first housing 10. The first opening 22 is provided in a portion of the first housing 10 adjacent to the first space 21*a*. The second opening is provided in a portion of the first housing 10 adjacent to the second space 21*b*. As a result, when the speaker cartridge according to the embodiment is connected to the electronic device so that the first space 21*a* is in communication with the outer space via the first opening 22 and the second space 21*b* is in communication with the inner space of the electronic device via the second opening, it is possible to easily realize a composite electrode device capable of generating a high-quality sound.

For example, it is possible to manufacture the speaker cartridge according to the embodiment in the following manner. First, a binder, a dispersing agent, a plasticizer, and a solvent are added to piezoelectric material powder, and the materials are stirred together to produce a slurry. Either a leaded piezoelectric material or an unleaded piezoelectric material may be used. Subsequently, green sheets are produced by molding the obtained slurry into a sheet shape. A conductive pattern which becomes an inner electrode is formed by printing a conductive paste on each of the green sheets, and a laminate molded body is produced by laminating the green sheets with conductive patterns on top of each other.

Subsequently, it is possible to obtain a stacked body by degreasing firing, and cutting the laminate molded body into predetermined dimensions. If necessary, an outer circumferential portion of the stacked body is machined. Subsequently, conductive patterns which become surface electrode layers are formed by printing a conductive paste on main surfaces in a stacking direction of the stacked body. Conductive patterns which become a pair of terminal electrodes are formed by printing a conductive paste on both side surfaces of the stacked body in a longitudinal direction (x-axis direction). It is possible to obtain a structure which is the exciter 11 by baking the electrodes at a predetermined temperature. Thereafter, piezoelectric layers of the exciter 11 are polarized by applying a DC voltage to the exciter 11 via the surface electrode layers or the pair of terminal electrodes so as to provide piezoelectricity to the exciter 11. In this manner, it is possible to obtain the exciter 11.

Subsequently, a circumferential edge of the film 12 to which tension is applied, is interposed and fixed between the frames 14*a* and 14*b* on which an adhesive is coated, and the film 12 is joined to the frames 14*a* and 14*b* by curing the adhesive. The exciter 11 is joined to the second main surface 12*c* of the vibration body 12*a* of the film 12 with an adhesive, and wirings are connected to the exciter 11. The resin layer 13 is formed by allowing resin to flow into the inside of the frame 14*a*, and curing the resin.

The first housing 10 is formed by joining together the spacers 15 and 16 and the panels 17 and 18, which have been prepared in advance, with a gluing agent or an adhesive, the first connector 20 is joined to the first housing 10 with an adhesive or the like, and the first connector 20 is connected to the exciter 11 via wirings (not illustrated). In this manner, it is possible to obtain the speaker cartridge in the embodiment.

Second Embodiment

Figure 8:
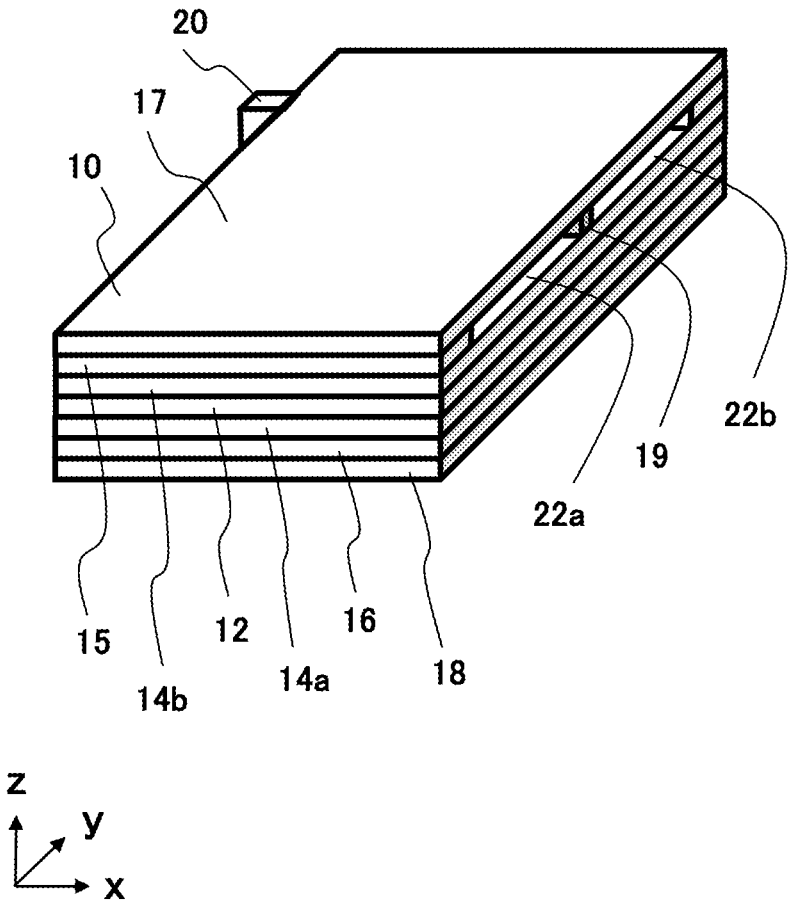
FIG. 8 is a perspective view schematically illustrating a speaker cartridge according to a second embodiment of the invention.
Figure 9:
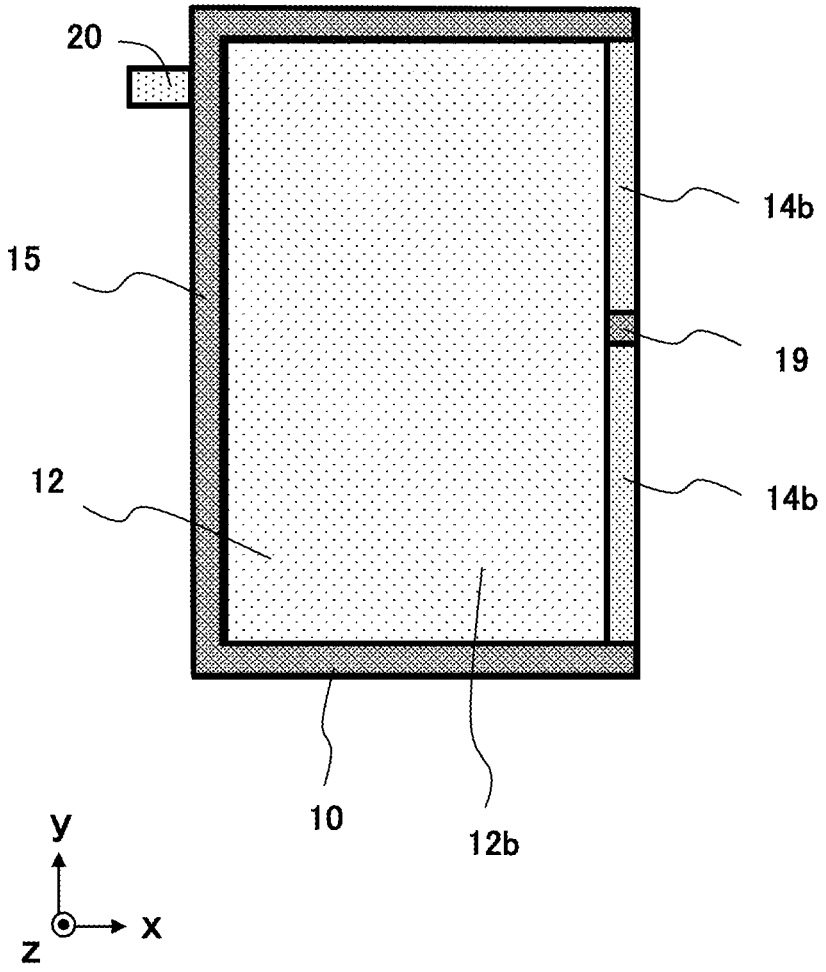
FIG. 9 is a top view schematically illustrating a speaker cartridge according to the second embodiment of the invention.

FIG. 8 is a perspective view schematically illustrating a speaker cartridge according to a second embodiment of the invention. FIG. 9 is a top view schematically illustrating the speaker cartridge according to the second embodiment of the invention, when viewed from the +z direction side. FIG. 8 illustrates a state where the panel 17 has been removed from the speaker cartridge. The points of difference between the speaker cartridges of the embodiment and the first embodiment will be described. The same reference signs will be assigned to the same constituent elements, and duplicated descriptions will be omitted.

As illustrated in FIGS. 8 and 9, in a sound generating apparatus of the embodiment, a supporting body 19 is disposed on a surface on the +z direction side of the frame 14*b* which is adjacent to the first opening 22, and the supporting body 19 supports the center of an end portion in the +x direction of the panel 17. The first opening 22 is divided into openings 22*a* and 22*b* by the supporting body 19. That is, the first opening 22 is constituted by the openings 22*a* and 22*b*. The rest of the configuration of the speaker cartridge is the same as that of the speaker cartridge in the first embodiment.

In the speaker cartridge according to the embodiment having such a configuration, it is possible to obtain the same effects as those of the speaker cartridge according to the first embodiment. Since the speaker cartridge according to the embodiment includes the supporting body 19, even if strength of the panel 17 is low, shapes of the openings 22*a* and 22*b* can be kept in desired shapes.

Third Embodiment

Figure 10:
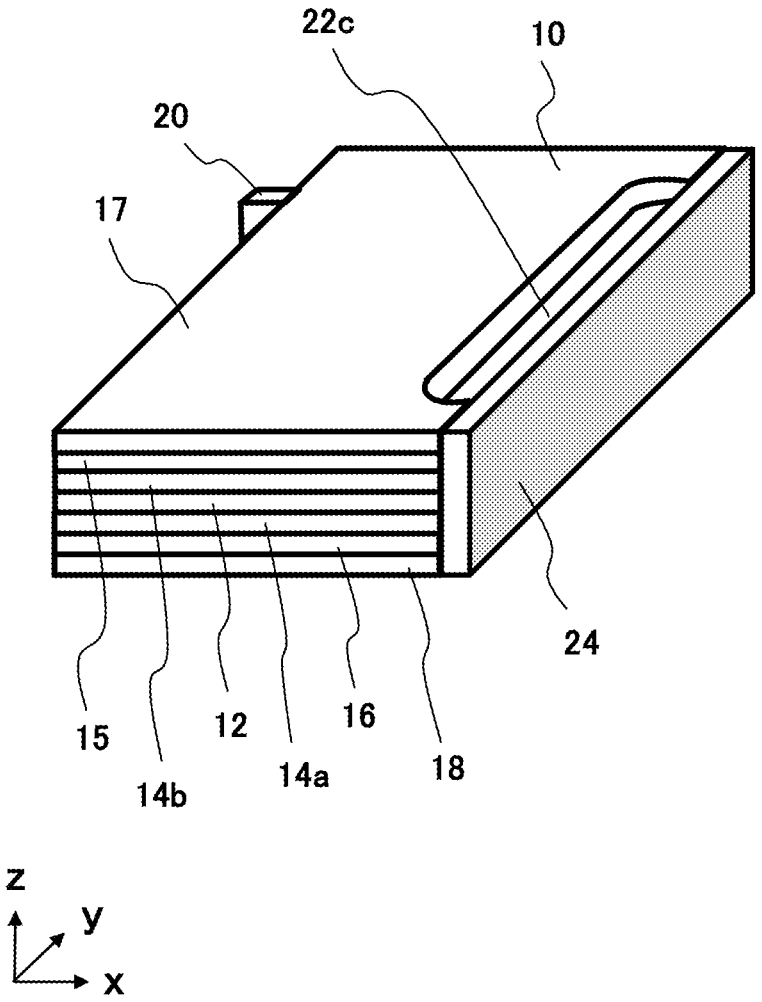
FIG. 10 is a perspective view schematically illustrating a speaker cartridge according to a third embodiment of the invention.
Figure 11:
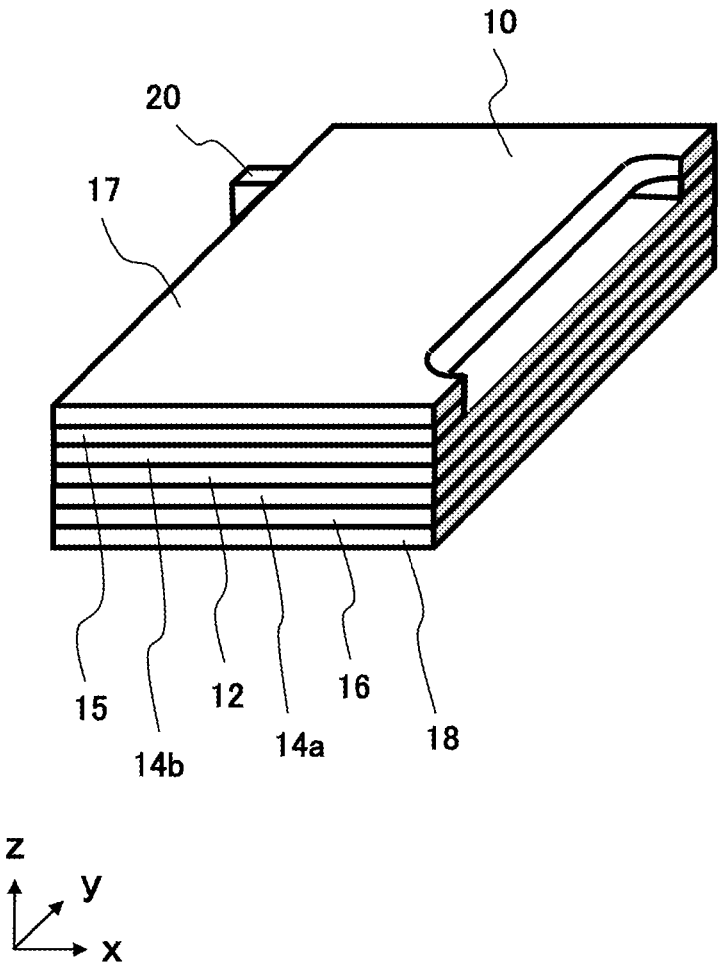
FIG. 11 is a perspective view schematically illustrating a state where a reflector 24 has been removed from the speaker cartridge according to the third embodiment of the invention.
Figure 12:
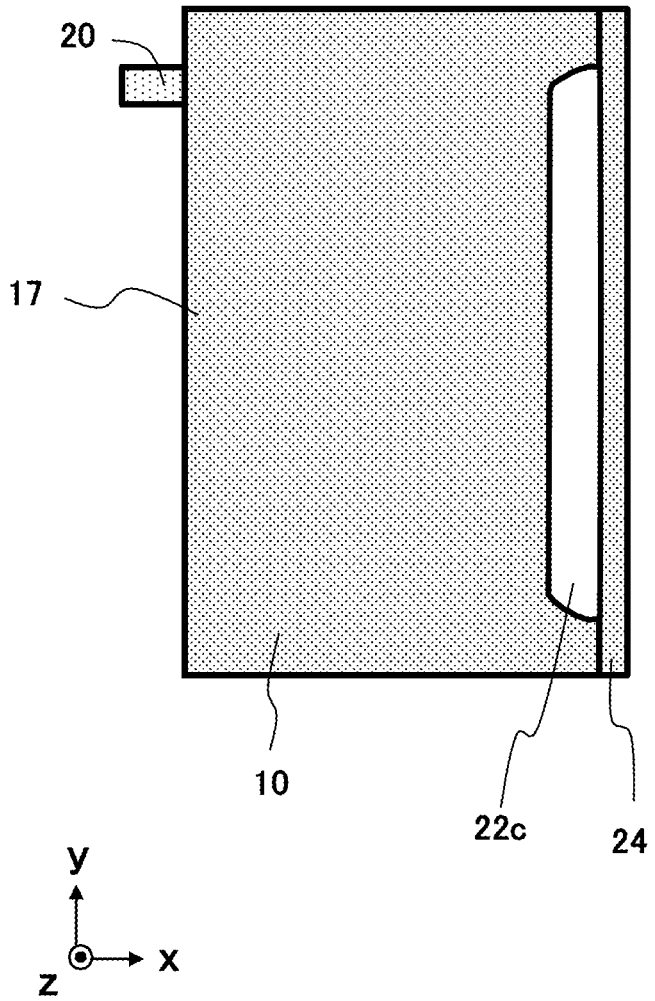
FIG. 12 is a top view schematically illustrating a speaker cartridge according to the third embodiment of the invention.

FIG. 10 is a perspective view schematically illustrating a speaker cartridge according to a third embodiment of the invention. FIG. 11 is a perspective view schematically illustrating the speaker cartridge according to the third embodiment of the invention, and illustrates a state where a reflector 24 has been removed from the speaker cartridge. FIG. 12 is a top view schematically illustrating the speaker cartridge according to the third embodiment of the invention, when viewed from the +z direction side. The points of difference between the speaker cartridges of the embodiment and the first embodiment will be described. The same reference signs will be assigned to the same constituent elements, and duplicated descriptions will be omitted.

As illustrated in FIGS. 10 to 12, in the speaker cartridge of the embodiment, the reflector 24 is joined to an end portion in the +x direction of the first housing 10 in which the first opening 22 is formed. The first opening 22 is blocked with the reflector 24. Instead, a cutout is formed in an end portion in the +x direction of the panel 17, and thereby a first opening 22*c* is formed between the panel 17 and the reflector 24. The outer space is in communication with the first space 21*a* via the first opening 22*c*.

In a case where the speaker cartridge according to the embodiment is used, an insertion depth of the speaker cartridge into an electronic device may be reduced so that the first opening 22*c* protrudes from an end portion in the +x direction of the electronic device. A portion of a housing of the electronic device with which the first opening 22*c* is covered may be cut out such that the first opening 22*c* is exposed to the outside of the electronic device.

In the speaker cartridge according to the embodiment having such a configuration, it is possible to obtain the same effects as those of the speaker cartridge according to the first embodiment. Since the speaker cartridge according to the embodiment includes the reflector 24 and the first opening 22*c*, it is possible to further increase the pressure on the +z direction side of a sound generated by the speaker cartridge compared to that of the speaker cartridge according to the first embodiment.

Fourth Embodiment

Figure 13:
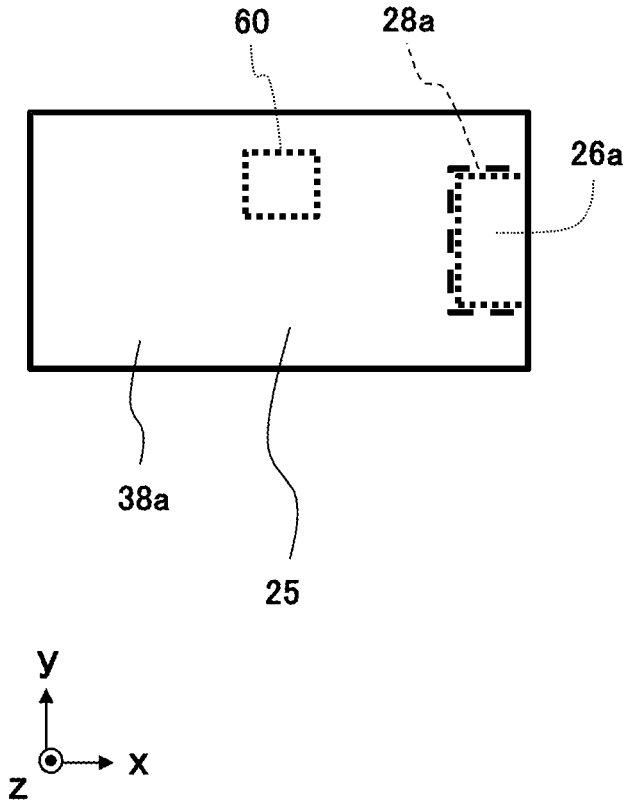
FIG. 13 is a top view schematically illustrating a composite electronic device according to a fourth embodiment of the invention, when viewed from the +z direction side.
Figure 14:
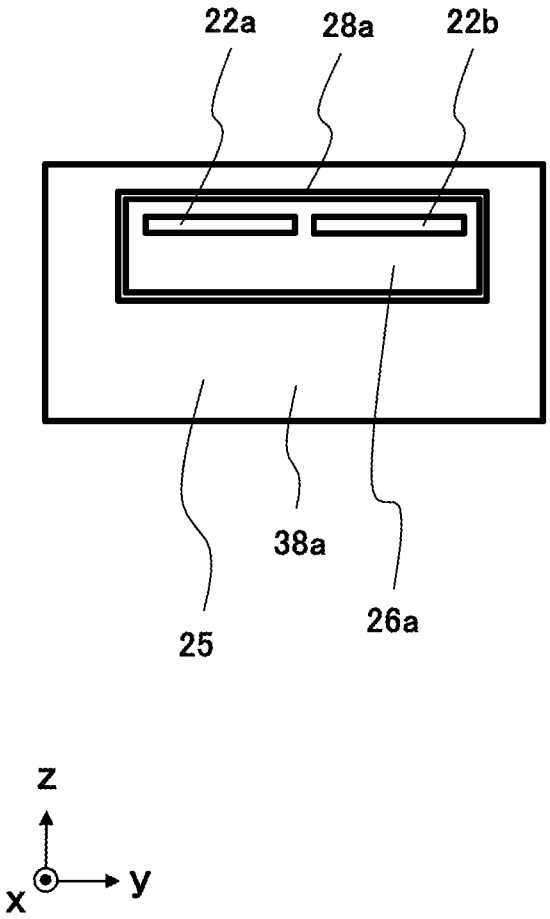
FIG. 14 is a top view schematically illustrating a composite electronic device according to the fourth embodiment of the invention, when viewed from the +x direction side.
Figure 15:
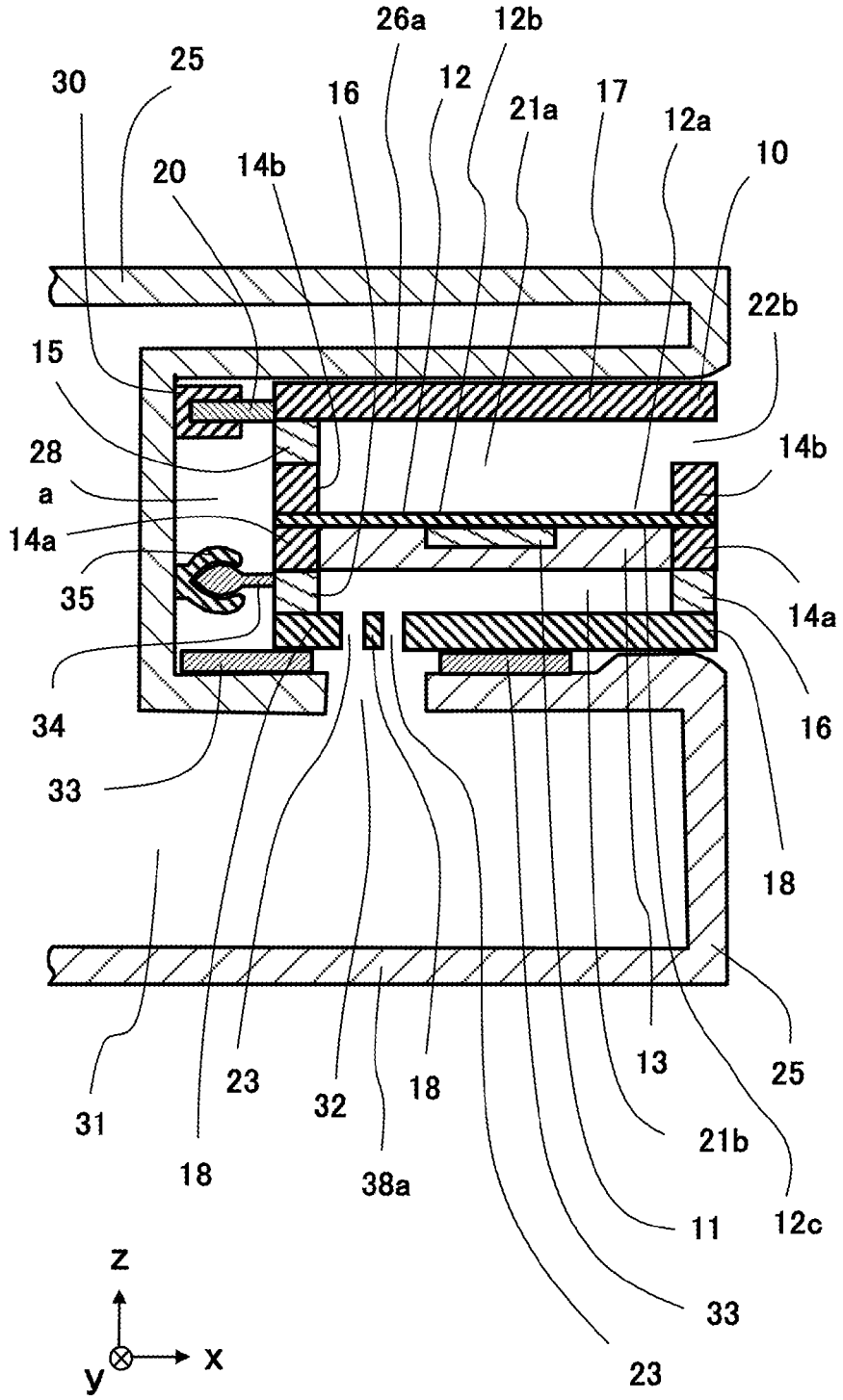
FIG. 15 is a sectional view schematically illustrating a portion of the composite electronic device according to the fourth embodiment of the invention.

FIG. 13 is a top view schematically illustrating a composite electronic device according to a fourth embodiment of the invention, when viewed from the +z direction side. FIG. 14 is a top view schematically illustrating the composite electronic device according to the fourth embodiment of the invention, when viewed from the +x direction side. FIG. 15 is a sectional view schematically illustrating a portion of the composite electronic device according to the fourth embodiment of the invention. The points of difference between the embodiment and the second embodiment will be described. The same reference signs will be assigned to the same constituent elements, and duplicated descriptions will be omitted.

As illustrated in FIGS. 13 to 15, the composite electronic device according to the embodiment includes a speaker cartridge 26*a* and an electronic device 38*a*. The speaker cartridge 26*a* is a speaker cartridge described in the second embodiment. The electronic device 38*a* includes a second housing 25; a second connector 30; and an electronic circuit 60.

The second housing 25 has a rectangular parallelepiped box-like exterior, and forms a third space 31 which is surrounded by the second housing 25. Various components including the electronic circuit 60 are accommodated in the third space 31. The second housing 25 may be formed of various materials such as resin, metal, ceramics, glass, and wood. The shape of the second housing 25 is not limited to a rectangular parallelepiped shape, and may be various shapes such as a regular tetrahedron, a truncated cone, and a sphere.

A slot 28 is formed in an end portion in the +x direction of the second housing 25. The slot 28*a* is a deep recess portion having a rectangular parallelepiped shape. The second connector and a joining portion 35 are provided in a portion of the second housing 25 which is positioned inside of the slot 28*a*. The second connector 30 is connected to the electronic circuit via wirings (not illustrated). The joining portion 35 is formed of a high elastic material. A recess portion is provided in an end portion on the +x direction side of the joining portion 35, and the end portion on the −x direction side of the joining portion 34 is inserted into the recess portion.

The speaker cartridge 26*a* is inserted into the slot 28 from the +x direction side. The joining portion 34 of the speaker cartridge 26*a* is inserted into and fitted to the joining portion 35 of the electronic device 38*a* so that the speaker cartridge 26*a* is detachably joined to the electronic device 38*a*. The first connector 20 of the speaker cartridge 26*a* is connected to the second connector 30 of the electronic device 38*a* so that the electronic circuit 60 of the electronic device 38*a* is electrically connected to the exciter 11 of the speaker cartridge 26*a*. An end portion on the +x direction side of the speaker cartridge 26*a* is exposed to an outer space of the electronic device 38*a* via an opening of the slot 28*a*. The first opening 22 (the openings 22*a* and 22*b*), which is provided in the end portion on the +x direction side of the speaker cartridge 26*a*, is also exposed to the outer space. The outer space represents a space outside of the electronic device 38*a* and the speaker cartridge 26*a*, and is a space in which a target who listens to a sound exists.

A third opening 32 is provided in the second housing 25. The third opening 32 is provided in a portion of the second housing 25 adjacent to the third space 31, that is, in a portion of the second housing 25 which faces the second opening (the plurality of through holes 23) of the speaker cartridge 26*a*. That is, the second opening of the speaker cartridge 26*a* and the third opening 32 of the electronic device 38*a* are disposed to face each other. The second space 21*b* is connected to the third space 31 via the second opening (the plurality of through holes 23) and the third opening 32. As a result, a sound generated at the second main surface 12*c* side of the vibration body 12*a* radiates to the third space 31, which is an inner space of the electronic device 38, via the second opening and the third opening 32.

A sound insulating member 33 is provided on an external surface of the second housing 25 so that the third opening 32 is continuously surrounded by the sound insulating member 33. The sound insulating member 33 is formed of a material that is less elastic than those of the first housing 10 and the second housing 25. The sound insulating member 33 is easily deformed by external force. In a case where the thickness of the sound insulating member 33 is compared to a gap formed between the first housing 10 and the second housing 25 when the speaker cartridge 26*a* is inserted into the slot 28*a*, the thickness of the sound insulating member 33 is larger than the gap. As a result, when the speaker cartridge 26*a* is inserted into the slot 28*a*, the sound insulating member 33 is deformed, the gap, which is formed between the first housing 10 and the second housing 25 along the circumference of the second opening and the third opening 32, is blocked with the sound insulating member 33. As a result, a sound generated at the second main surface 12*c* side of the vibration body 12*a* can be prevented from leaking to the outer space.

Such a sound insulating member 33 may be formed of various known materials, for example, a rubber material such as urethane rubber, and a soft resin material such as silicone resin, which are elastic and are easily deformed. In particular, a porous rubber material such as urethane foam may be preferably used. The sound insulating member 33 may be joined to the second housing 25 with various known joining members such as an adhesive.

When electric signals are supplied from the electronic circuit 60 to the exciter 11, the vibration body 12*a* is vibrated via vibration of the exciter 11, and a sound is generated. A sound generated at the first main surface 12*b* side of the vibration body 12*a* radiates to the outside of the electronic device 38*a* via the first opening (the openings 22*a* and 22*b*) of the speaker cartridge 26*a*. A sound generated at the second main surface 12*c* side of the vibration body 12*a* radiates to the third space 31 via the second opening and the third opening 32.

As described above, the composite electronic device according to the embodiment includes the electronic device 38*a*, and the speaker cartridge 26*a*. The speaker cartridge 26*a* is detachably connected to the electronic device 38*a*. The speaker cartridge 26*a* includes the vibration body 12*a*; the exciter 11; the first housing 10; and the first connector 20. The exciter 11 is attached to the vibration body 12*a*. The first housing 10 surrounds and accommodates the vibration body 12*a* therein. The first connector 20 is electrically connected to the exciter 11. The vibration body 12*a* has the first main surface 12*b* and the second main surface 12*c* which are opposite to each other. The composite electronic device according to the embodiment includes the first space 21*a* and the second space 21*b*. The first space 21*a* is a space which is surrounded by the first main surface 12*b* of the vibration body 12*a* and the first housing 10. The second space 21*b* is a space which is surrounded by the second main surface 12*c* of the vibration body 12*a* and the first housing 10. The electronic device 38*a* includes the electronic circuit 60; the second connector 30; and the second housing 25. The second connector 30 is connected to the electronic circuit 60. The electronic device 38*a* includes the third space 31 which is surrounded by the second housing 25. The first connector 20 is connected to the second connector 30 so that the exciter 11 is electrically connected to the electronic circuit 60. The first opening 22 is provided in a portion of the first housing 10 adjacent to the first space 21*a*. The first space 21*a* is in communication with the outer space via the first opening 22. The second opening is provided in a portion of the first housing 10 adjacent to the second space 21*b*. The second space 21*b* is in communication with the third space 31 via the second opening. Since it is possible to reduce the possibility that a sound generated at the first main surface 12*b* side of the vibration body 12*a* and a sound generated at the second main surface 12*c* side are mixed together and cancel each other out in the outer space, the composite electronic device according to the embodiment having such a configuration is capable of generating a sound having a high sound pressure. Since the material and internal structure of the second housing 25 does not substantially affect a sound which radiates to the outer space via the first opening 22, the composite electronic device according to the embodiment is capable of easily generating a high-quality sound. Since it is possible to prevent a decrease in sound quality and to reduce the second space 21*b*, it is possible to reduce the size of the composite electronic device according to the embodiment. It is possible to easily change the quality of a sound generated by the composite electronic device in the embodiment by switching the speaker cartridge 26*a* to another speaker cartridge having different sound characteristics.

In the composite electronic device according to the embodiment, the sound insulating member 33 is provided between the first housing 10 and the second housing 25, and separates the second and third spaces 21*b* and 31 from the outer space. The sound insulating member 33 is formed of a material which is less elastic than the material of the first housing 10 and the material of the second housing 25. As a result, it is possible to reduce leakage of a sound which is generated at the second main surface 12*c* side of the vibration body 12*a*, to the outer space. As a result, it is possible to reduce a decrease in the pressure of a sound radiating to the outer space.

Since a joining portion through which the first housing 10 is detachably joined to the second housing 25, is provided in at least one of the firsts housing 10 and the second housing 25, it is possible to easily, detachably connect the speaker cartridge 26*a* to the electronic device 38*a*. The composite electronic device according to the embodiment includes the joining portions and 35 through which the first housing 10 is detachably joined to the second housing 25. The joining portion 34 is provided in the first housing 10, and the joining portion 35 is provided in the second housing 25. Alternatively, a joining portion through which the first housing 10 is detachably joined to the second housing 25, may be provided in at least one of the firsts housing 10 and the second housing 25, depending on the shape of the joining portion.

In the composite electronic device according to the embodiment, the slot 28*a* is provided in the second housing 25, and the speaker cartridge 26*a* is inserted into the slot 28*a*. As a result, it is possible to make the exterior of the composite electronic device look good.

In the composite electronic device according to the embodiment, the second opening and the first connector 20 are positioned inside the slot 28. The first opening 22 is exposed to the outer space in a state where the speaker cartridge 26 is inserted into the slot 28. As a result, it is not necessary to provide a sound guiding portion through which the first opening 22 is connected to the outer space, it is easy to mechanically and electrically connect together the speaker cartridge 26*a* and the electronic device 38*a*, and it is possible to improve reliability of connection between the speaker cartridge 26*a* and the electronic device 38*a*. For example, the first opening 22 may be covered with a mesh such as a metal mesh that does not considerably affect a sound.

In the embodiment, when a first direction and a second direction are opposite to each other, the first connector 20 is located in an end portion in the first direction (−x direction) of the first housing 10, and the first opening 22 is located in an end portion in the second direction (+x direction) of the first housing 10. As a result, when the end portion on the −x direction side of the speaker cartridge 26*a* is connected to the electronic device 38*a*, the first opening 22 can be easily exposed to the outer space.

In the embodiment, the joining portion 34 is provided in the first housing 10 of the speaker cartridge 26*a*. As a result, it is easy to attach to and detach the speaker cartridge 26*a* from the first housing 10.

In the embodiment, the electronic device 38 includes the electronic circuit 60; the second connector 30 connected to the electronic circuit 60; and the second housing 25. The electronic device 38 includes the third space 31 and the third opening 32. The third space 31 is a space which is surrounded by the second housing 25. The third opening 32 is provided in a portion of the second housing 25 adjacent to the third space 31. As a result, when the speaker cartridge 26*a* is attached so that the first connector 20 is connected to the second connector 30 and the second opening is connected to the third opening 32, a good-quality sound having a high sound pressure are capable of easily radiating to the outer space.

In the electronic device 38*a* according to the embodiment, the sound insulating member 33 which surrounds the third opening is provided in the second housing 25. The sound insulating member 33 is formed of a material which is less elastic than that of the second housing 25. As a result, it is possible to prevent a sound which is generated at the second main surface 12*c* of the vibration body 12*a*, from leaking to the outer space when the speaker cartridge 26*a* is attached to the electronic device 38*a*.

In the electronic device 38*a* according to the embodiment, the joining portion 35 is provided in the second housing 25. As a result, the speaker cartridge 26*a* is easily, detachably connected to the electronic device 38*a*.

The composite electronic device according to the embodiment may have various other configurations and functions. For example, the composite electronic device may include an antenna or a communication circuit, and may have a communication function. The composite electronic device may include an image processing circuit or a display apparatus, and may have a function of displaying a moving picture or still images. The composite electronic device may include an arithmetic circuit, an input device, an output device, and so on, and may have a function of executing commanded processes and displaying results of the execution. That is, the composite electronic device in the embodiment may be a television, a radio, an audio device, a personal computer, a tablet terminal, or the like. In addition, the composite electronic device according to the embodiment may be various electronic devices such as a vacuum cleaner, a washing machine, a refrigerator, and a microwave oven, which have a function of generating a sound.

Fifth Embodiment

Figure 16:
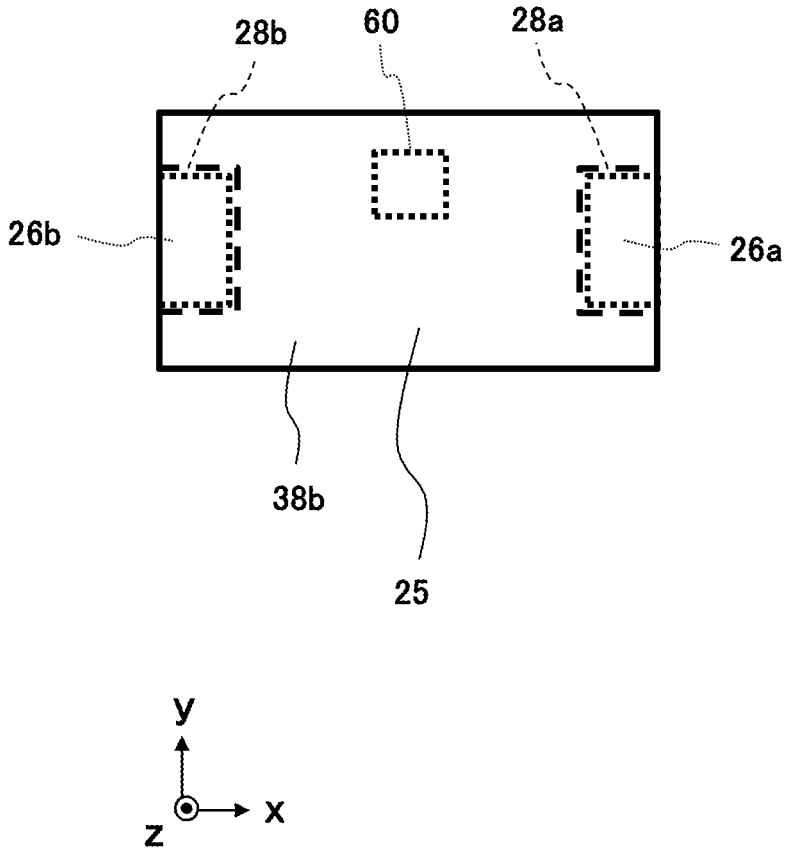
FIG. 16 is a top view schematically illustrating a composite electronic device according to a fifth embodiment of the invention.

FIG. 16 is a top view schematically illustrating a composite electronic device according to a fifth embodiment of the invention, when viewed from the +z direction side. The points of difference between the composite electronic devices of the embodiment and the fourth embodiment will be described. The same reference signs will be assigned to the same constituent elements, and duplicated descriptions will be omitted.

The composite electronic device according to the embodiment includes an electronic device 38*b*; the speaker cartridge 26*a*; and a speaker cartridge 26*b*. The electronic device 38*b* has the same structure as that of the electronic device 38*a* according to the fourth embodiment, except that a slot 28*b* is further provided. The speaker cartridge 26*b* is the same as the speaker cartridge 26*a*, and is rotated by 180° around a z-axis relative to the speaker cartridge 26*a*. The slot 28*b* has the same structure as that of the slot 28*a*, and is rotated by 180° around the z-axis relative to the slot 28*a*. The speaker cartridge 26*b* is inserted into the slot 28*b*.

The slot 28*b* is formed in an end portion in the −x direction of the second housing 25, and the speaker cartridge 26*b* is inserted into the slot 28*b* from the −x direction side. The first connector 20 of the speaker cartridge 26*b* is connected to the second connector 30 provided inside the slot 28*b*. An end portion on the −x direction side of the speaker cartridge 26*b* is exposed to the outside of the electronic device 38*b* via an opening of the slot 28*b*. The first opening (the openings 22*a* and 22*b*), which is provided in an end portion on the −x direction side of the speaker cartridge 26*b*, is also exposed to the outside of the electronic device 38*b*.

The second connector 30, which is provided inside the slot 28*b*, is connected to the electronic circuit 60 via wirings (not illustrated). Electric signals are also supplied from the electronic circuit 60 to the exciter 11 of the speaker cartridge 26*b*, and a sound generated at the second main surface 12*c* side of the vibration body 12*a* radiates to the outer space via the first opening (the openings 22*a* and 22*b*) of the speaker cartridge 26*b*.

The composite electronic device according to the embodiment having such a configuration is capable of generating a sound from both the speaker cartridge 26*a* disposed in an end portion in the +x direction of the electronic device 38*b* and the speaker cartridge 26*b* disposed in an end portion in the −x direction of the electronic device 38*b*. As a result, it is possible to enable stereo reproduction, and to generate a very realistic sound.

Sixth Embodiment

Figure 17:
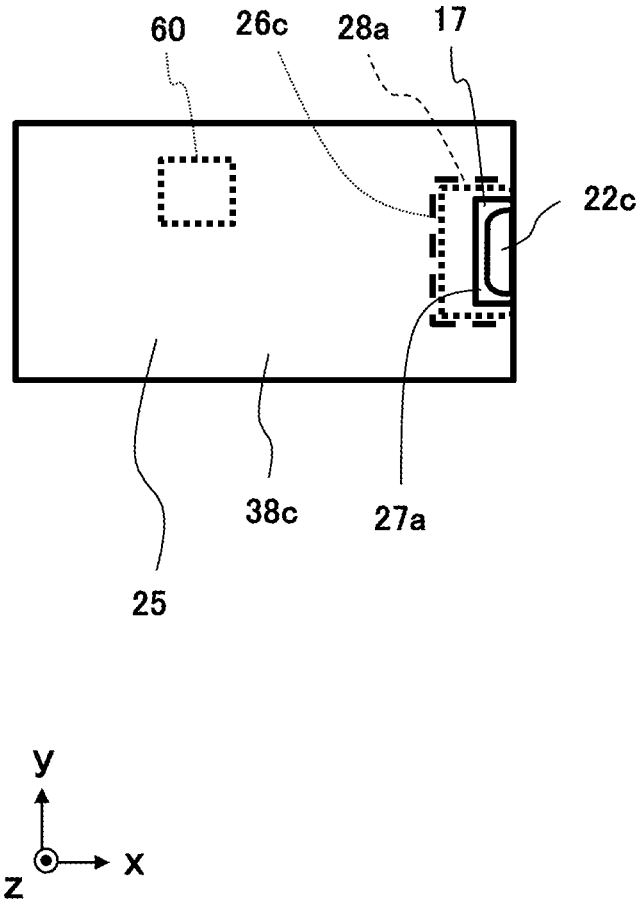
FIG. 17 is a top view schematically illustrating a composite electronic device according to a sixth embodiment of the invention.

FIG. 17 is a top view schematically illustrating a composite electronic device according to a sixth embodiment of the invention, when viewed from the +z direction side. The points of difference between the composite electronic devices of the embodiment and the fourth embodiment will be described. The same reference signs will be assigned to the same constituent elements, and duplicated descriptions will be omitted.

As illustrated in FIG. 17, the composite electronic device according to the embodiment includes an electronic device 38*c* and a speaker cartridge 26*c*. The speaker cartridge 26*c* is a speaker cartridge described in the third embodiment. The electronic device 38*c* has the same structure as that of the electronic device 38*a* according to the fourth embodiment, except that a cutout 27*a* is provided on the +z direction side of an end portion in the +x direction of the second housing 25.

As illustrated in FIG. 17, in the composite electronic device according to the embodiment, the speaker cartridge 26*c* is inserted into the slot 28*a* of the electronic device 38*c*. A first opening 22*c* of the speaker cartridge 26*c* is exposed to the outside of the electronic device 38*c* via the cutout 27*a*.

The speaker cartridge 26*c* is inserted into the slot 28*a* from the +x direction side. The first connector 20 of the speaker cartridge 26*c* is connected to the second connector 30 provided inside the slot 28*a*. Electric signals are supplied from the electronic circuit 60 to the exciter 11 of the speaker cartridge 26*c*, and a sound which is generated at the first main surface 12*b* side of the vibration body 12*a*, radiates to the outer space via the first opening 22*c* of the speaker cartridge 26*c*.

In the composite electronic device according to the embodiment having such a configuration, the first opening 22*c* of the speaker cartridge 26*c* is exposed to a surface on the +z direction side of the electronic device 38*c*. As a result, it is possible to increase pressure on the +z direction side of a sound generated by the composite electronic device.

In the embodiment, the first opening 22*c* of the speaker cartridge 26*c* is exposed to the outer space via the cutout 27*a*; however, the invention is not limited to that configuration. For example, the insertion depth of the speaker cartridge 26*c* into the slot 28*a* may be reduced so that the first opening 22*c* protrudes from an end portion in the +x direction of the electronic device 38*c*.

Seventh Embodiment

Figure 18:
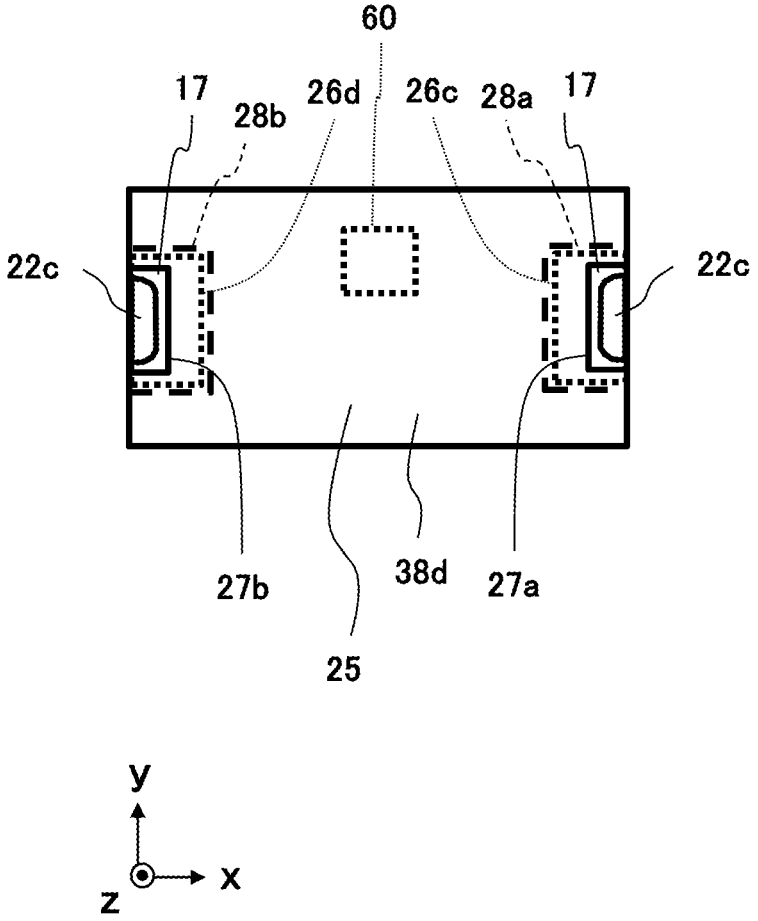
FIG. 18 is a top view schematically illustrating a composite electronic device according to a seventh embodiment of the invention.

FIG. 18 is a top view schematically illustrating a composite electronic device according to a seventh embodiment of the invention, when viewed from the +z direction side. The points of difference between the composite electronic devices of the embodiment and the sixth embodiment will be described. The same reference signs will be assigned to the same constituent elements, and duplicated descriptions will be omitted.

As illustrated in FIG. 18, the composite electronic device according to the embodiment includes an electronic device 38*d*; the speaker cartridge 26*c*; and a speaker cartridge 26*d*. The electronic device 38*d* has the same structure as that of the electronic device 38*c* according to the sixth embodiment, except that the slot 28*b* and a cutout 27*b* are further provided. The speaker cartridge 26*d* is the same as the speaker cartridge 26*c*, and is rotated by 180° around the z-axis relative to the speaker cartridge 26*c*. The slot 28*b* has the same structure as that of the slot 28*a*, and is rotated by 180° around the z-axis relative to the slot 28*a*. The speaker cartridge 26*d* is inserted into the slot 28*b*. The cutout 27*b* is provided on the +z direction side of an end portion in the −x direction of the second housing 25. The first opening 22*c* of the speaker cartridge 26*d* is exposed to the outer space via the cutout 27*b*.

The speaker cartridge 26*d* is inserted into the slot 28*b* from the −x direction side. The first connector 20 of the speaker cartridge 26*d* is connected to the second connector 30 provided inside the slot 28*b*. Electric signals are supplied from the electronic circuit 60 to the exciter 11 of the speaker cartridge 26*d*, and a sound which is generated at the first main surface 12*b* side of the vibration body 12*a*, radiates to the outer space via the first opening 22*c* of the speaker cartridge 26*d*.

The composite electronic device according to the embodiment having such a configuration is capable of generating a sound from both the speaker cartridge 26*c* disposed in an end portion in the +x direction of the electronic device 38*d* and the speaker cartridge 26*d* disposed in an end portion in the −x direction of the electronic device 38*d*. As a result, it is possible to enable stereo reproduction, and to generate a very realistic sound.

Eighth Embodiment

Figure 19:
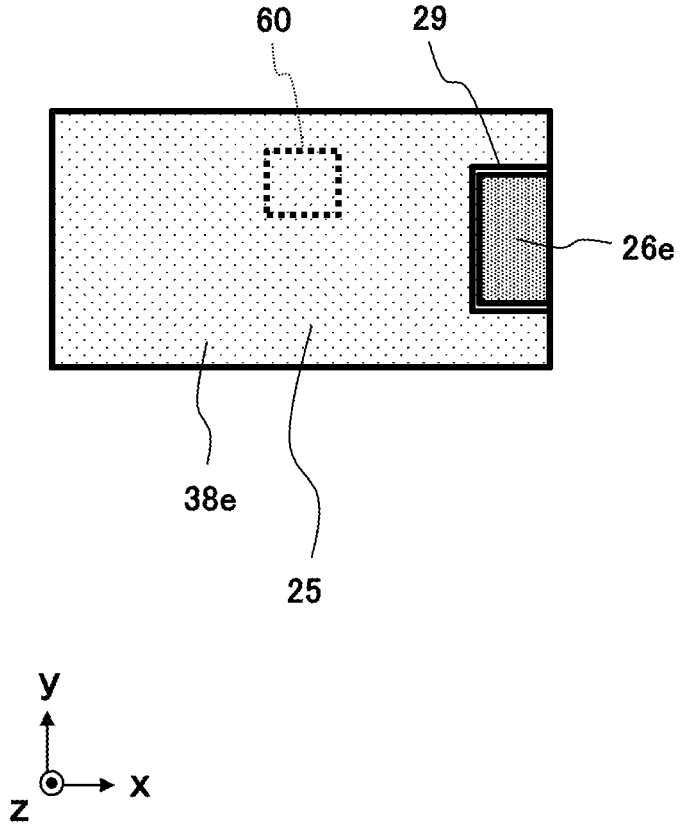
FIG. 19 is a top view schematically illustrating a composite electronic device according to an eighth embodiment of the invention.
Figure 20:
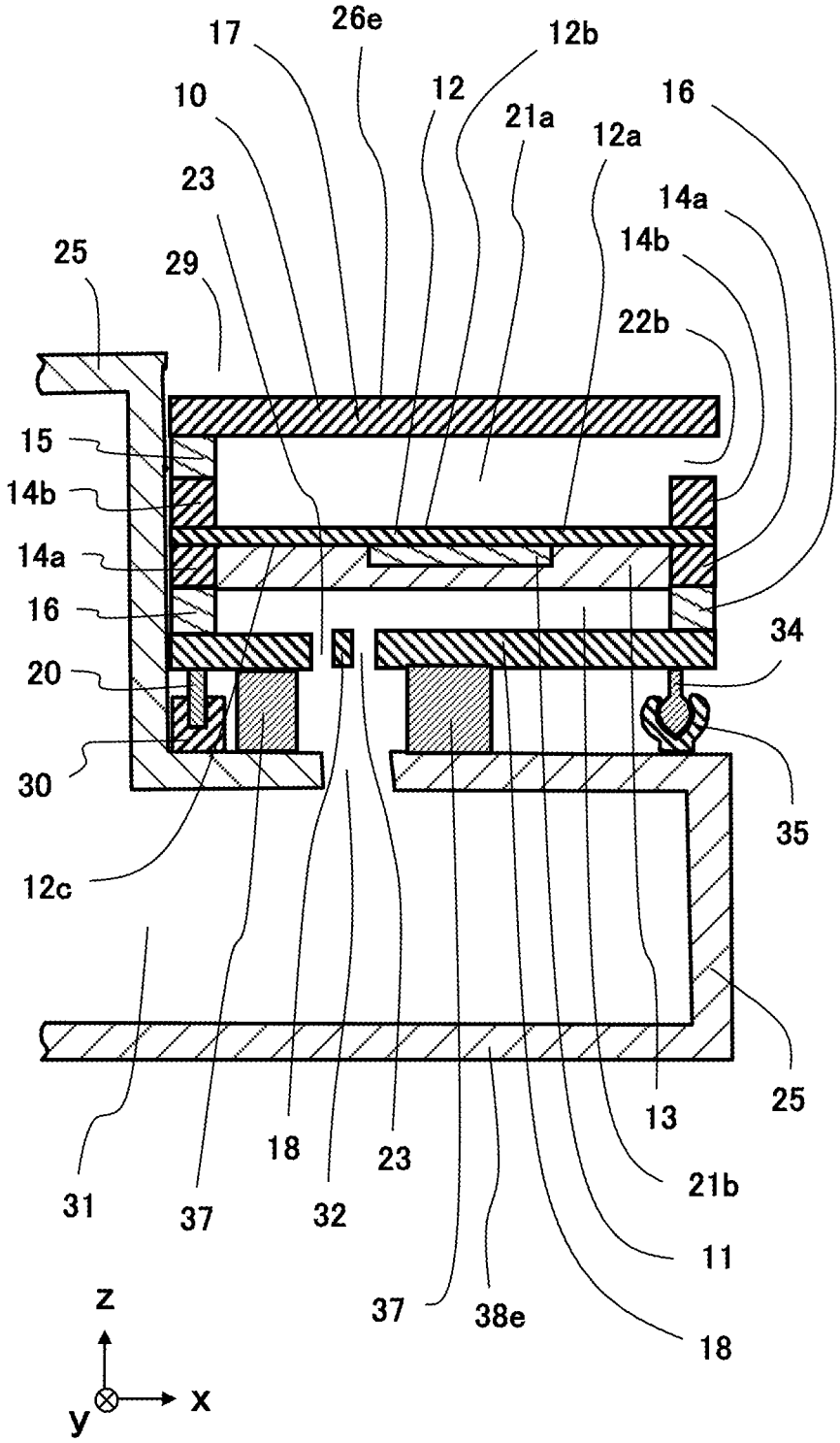
FIG. 20 is a sectional view schematically illustrating a portion of the composite electronic device according to the eighth embodiment of the invention.

FIG. 19 is a top view schematically illustrating a composite electronic device according to an eighth embodiment of the invention, when viewed from the +z direction side. FIG. 20 is a sectional view schematically illustrating a portion of the composite electronic device according to the eighth embodiment of the invention. The points of difference between the composite electronic devices of the embodiment and the fourth embodiment will be described. The same reference signs will be assigned to the same constituent elements, and duplicated descriptions will be omitted. As illustrated in FIGS. 19 and 20, the composite electronic device according to the embodiment includes an electronic device 38*e* and a speaker cartridge 26*e*.

The electronic device 38*e* has substantially the same structure as that of the electronic device 38*a*. The electronic device 38*e* are different from the electronic device 38*a* only in that a recess portion 29 is provided instead of the slot 28*a*, the second connector 30 and the joining portion 35 are disposed at different positions, and the sound insulating member 33 is not provided. The recess portion 29 is provided on the +z direction side of an end portion in the x-axis direction of the second housing 25 of the electronic device 38*e*. The second connector 30 and the joining portion 35 are disposed on a surface on the +z direction side of a portion of the second housing 25 in which the recess portion 29 is formed.

The speaker cartridge 26*e* has substantially the same structure as that of the speaker cartridge 26*a*. The speaker cartridge 26*e* is different from the speaker cartridge 26*a* only in that a sound insulating member 37 is provided, and the first connector 20 and the joining portion 34 are disposed at different positions. The joining portion 34 and the first connector 20 are disposed on a surface on the −z direction side of the first housing 10. The sound insulating member 37 is provided on the surface on the −z direction side of the first housing 10, and the sound insulating member 37 surrounds the second opening formed of the plurality of through holes 23. The sound insulating member 37 has the same shape and material as those of the sound insulating member 33, and provides the same effects as those of the sound insulating member 33.

The speaker cartridge 26*e* is fitted into the recess portion 29 of the electronic device 38*e* from the +x direction side. The joining portion 34 of the speaker cartridge 26*e* is joined to the joining portion 35 provided in the recess portion 29. The first connector 20 of the speaker cartridge 26*e* is connected to the second connector 30 provided in the recess portion 29. Electric signals are supplied from the electronic circuit 60 to the exciter 11 of the speaker cartridge 26*e*, and a sound which is generated at the first main surface 12*b* side of the vibration body 12*a*, radiates to the outer space via a first opening (the openings 22*a* and 22*b*) of the speaker cartridge 26*e*. As such, the composite electronic device according to the embodiment also has the same functions as those of the composite electronic device according to the fourth embodiment.

In the composite electronic device according to the embodiment, the recess portion 29 is provided in the second housing 25 of the electronic device 38*e*, and at least a portion of the first housing 10 of the speaker cartridge 26*e* is fitted into the recess portion 29. As a result, it is possible to confirm whether the speaker cartridge 26*e* has been installed, from the exterior, and it is possible to prevent the speaker cartridge 26*e* from considerably protruding outwardly.

In the embodiment, the sound insulating member 37 which surrounds a second opening of the speaker cartridge 26*e*, is provided in the first housing 10. The sound insulating member 37 is formed of a material which is less elastic than that of the first housing 10. As a result, it is possible to prevent a sound which is generated at the second main surface 12*c* of the vibration body 12*a*, from leaking to the outer space when the speaker cartridge 26*e* is attached to the electronic device 38*e*.

Modified Example

The invention is not limited to the aforementioned embodiments, and various changes and modifications are possible without departing from the scope of the invention.

In the aforementioned embodiments, a piezoelectric element is used as the exciter 11; however, the exciter 11 is not limited to a piezoelectric element. The exciter 11 may have a function of converting electric signals into mechanical vibration. Another type of exciter having a function of converting electric signals into mechanical vibration may be used as the exciter 11. For example, an electrodynamic exciter, an electrostatic exciter, or an electromagnetic exciter, which are well known as an exciter that vibrates a speaker, may be used as the exciter 11. The electrodynamic exciter vibrates a coil disposed between magnetic poles of a permanent magnet by allowing current to flow the coil. The electrostatic exciter vibrates two metal facing each other plates by allowing bias and electric signal to flow to the two metal plates. The electromagnetic exciter vibrates a thin steel plate by allowing electric signals to flow a coil.

In the aforementioned embodiments, one exciter 11 is attached to the surface of the film 12; however, the invention is not limited to that configuration. For example, two or more exciters may be attached to the surface of the film 12.

Example

Hereinafter, a specific example of the invention will be described. A composite electronic device according to the fifth embodiment illustrated in FIG. 16 was produced, and characteristics of the composite electronic device were evaluated.

First, a binder, a dispersing agent, a plasticizer, a solvent, and piezoelectric material powder containing lead zirconate titanate (PZT) in which a part of Zr was replaced with Sb are mixed and kneaded via ball mill mixing to produce a slurry. Green sheets were produced from the obtained slurry by a doctor blade method. A conductive pattern which became an inner electrode layer was formed by applying a conductive paste containing Ag and Pd to each of the green sheets by screen printing in a predetermined shape. A laminate molded body was produced by laminating the green sheets formed with conductive patterns and other green sheets and pressurizing the laminated green sheets. A stacked body was obtained by degreasing the laminate molded body in the atmosphere at 500° C. for one hour, and thereafter firing the laminate molded body in the atmosphere at 1100° C. for three hours.

Subsequently, tip ends of the inner electrode layers were exposed to side surfaces of the stacked body by cutting both end surface portions of the obtained stacked body in a longitudinal direction via dicing. Surface electrode layers were formed by applying a conductive paste containing Ag and glass to both side main surfaces of the stacked body by screen printing. Thereafter, terminal electrodes were formed by applying a conductive paste containing Ag and glass to both side surfaces of the stacked body in the longitudinal direction by a dip method, and baking the stacked body in the atmosphere at 700° C. for 10 minutes. As a result, the stacked body was produced. The produced stacked body had a shape having a width of 14 mm, a length of 36 mm, and a thickness of 0.1 mm. The exciter 11 which was a bimorph-type laminated piezoelectric element, was obtained by performing polarization in which a voltage of 100 V was applied to the stacked body via the terminal electrodes for two minutes.

Subsequently, the film 12 having a thickness of 25 μm formed of PET was prepared, and the film 12 was fixed to the frames 14*a* and 14*b* in a state where tension was applied to the film 12. As the frame 14*a*, a stainless frame having a thickness of 0.3 mm was used, and as the frame 14*b*, a stainless frame having a thickness of 0.5 mm was used. A dimension of the film 12 inside of the frames 14*a* and 14*b* was set to a length of 60 mm and a width of 30 mm. The exciter 11 was bonded to one main surface of the fixed film 12 with an adhesive, and wirings were connected to the exciter 11. The resin layer 13 was formed by filling the inside of the frame 14*a* with acrylic resin up to the same height as that of the frame 14*a*, and curing the acrylic resin.

Subsequently, the first housing 10 was formed using the spacers 15 and 16 and the panels 17 and 18 which were prepared in advance. Each of the spacers 15 and 16 was formed of stainless steel having a thickness of 1 mm. Each of the panels 17 and 18 was formed of an acrylic plate having a thickness of 1 mm. Each of the plurality of through holes 23 formed in the panel 18 had a circular shape with a diameter of 1 mm. The exterior of the first housing 10 was a rectangular parallelepiped shape having a length of 65 mm and a width of 35 mm. Double-sided tape was used to join together the frames 14*a* and 14*b*, the spacers 15 and 16, and the panels 17 and 18. In this manner, the speaker cartridge 26*a* and the speaker cartridge 26*b* were produced.

Subsequently, the second housing 25 of the electronic device 38*b* illustrated in FIG. 16 was formed of an acrylic plate. The speaker cartridge 26*a* was inserted into the slot 28*a* formed in the second housing 25, and the speaker cartridge 26*b* was inserted into the slot 28*b*. The second housing 25 had a rectangular parallelepiped shape having a length of 260 mm, a width of 180 mm, and a thickness of 10 mm. Double-sided tape was used to join together the acrylic plates.

A sine wave having an effective value of 7 V was applied to the exciter 11 of each of the speaker cartridges 26*a* and 26*b*, and frequency characteristics of sound pressure were measured at a position which was spaced by 25 cm in the +z direction from the center of a surface on the +z direction side of the second housing 25. Results are illustrated in FIG. 21.

Figure 21:
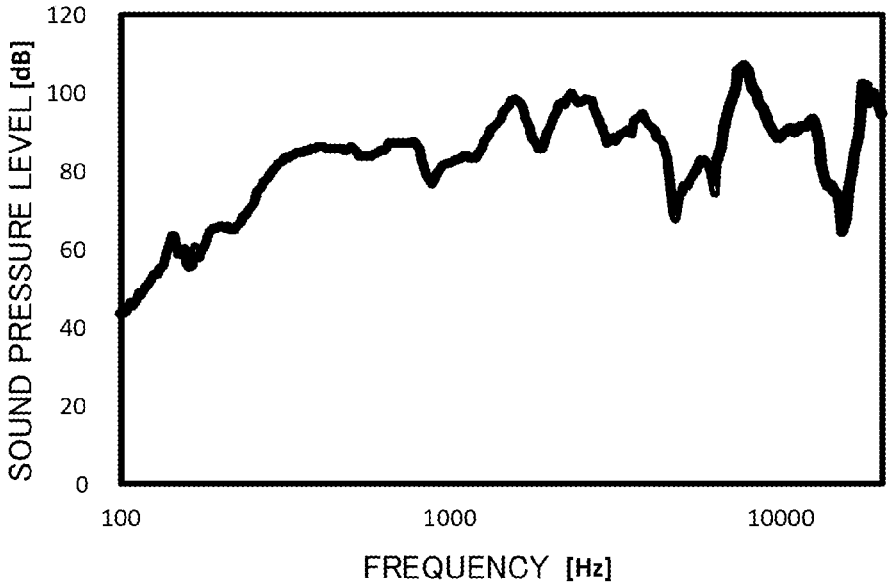
FIG. 21 is a graph illustrating frequency characteristic versus the pressure level of a sound generated by the composite electronic device according to the fifth embodiment of the invention.

In a graph illustrated in FIG. 21, a horizontal axis illustrates a frequency, and a vertical axis illustrates a sound pressure level. According to the graph illustrated in FIG. 21, sound quality is determined to be good in that sound pressure level is high in a wide range of frequencies, a sound pressure level has a flat frequency characteristic, and distortion is small. As a result, effectiveness of the invention could be confirmed.

REFERENCE SIGNS LIST

10: First housing
11: Exciter
12*a*: Vibration body
20: First connector
21*a*: First space
21*b*: Second space
22, 22*a*, 22*b*, 22*c*: First opening
23: Through hole
25: Second housing
26*a*, 26*b*, 26*c*, 26*d*, 26*e*: Speaker cartridge
28*a*, 28*b*: Slot
29: Recess portion
30: Second connector
31: Third space
33, 37: Sound insulating member
34: Joining portion
35: Joining portion
38*a*, 38*b*, 38*c*, 38*d*, 38*e*: Electronic device
60: Electronic circuit

The invention claimed is:

1. A composite electronic device, comprising:
an electronic device; and
a speaker cartridge detachably connected to the electronic device,
the speaker cartridge including
a vibration body, an exciter attached to the vibration body, a first housing which surrounds and accommodates the vibration body therein, and a first connector electrically connected to the exciter,
the vibration body having a first main surface and a second main surface which are opposite to each other,
the speaker cartridge being provided with a first space surrounded by the first main surface of the vibration body and the first housing, and a second space surrounded by the second main surface of the vibration body and the first housing,
the electronic device including an electronic circuit, a second connector connected to the electronic circuit, and a second housing,
the second housing being provided with a third space formed therein,
the first connector being connected to the second connector, the exciter being electrically connected to the electronic circuit,
a portion of the first housing adjacent to the first space being provided with a first opening, the first opening being exposed to an outside of the electronic device, the first space being in communication with an outer space via the first opening,
a portion of the first housing adjacent to the second space being provided with a second opening, a third opening being provided in a portion of the second housing adjacent to the third space, the second space being in communication with the third space via the second opening and the third opening,
the third space being not in communication with the outer space.

2. The composite electronic device according to claim 1,
wherein a sound insulating member which prevents sound transmission from the second space and the third space to the outer space is provided between the first housing and the second housing, and
the sound insulating member is formed of a material which is less elastic than a material of the first housing and a material of the second housing.

3. The composite electronic device according to claim 1,
wherein a joining portion through which the first housing is detachably joined to the second housing, is provided in at least one of the first housing and the second housing.

4. The composite electronic device according to claim 1,
wherein a slot is provided in the second housing, and the speaker cartridge is inserted into the slot.

5. The composite electronic device according to claim 4,
wherein the second opening and the first connector are positioned inside the slot, and
the first opening is exposed to an outer space in a state where the speaker cartridge is inserted into the slot.

6. The composite electronic device according to claim 1,
wherein a recess portion is provided in the second housing, and at least a portion of the first housing is fitted into the recess portion.

7. The composite electronic device according to claim 1,
wherein the speaker cartridge is configured so that
when a first direction and a second direction are opposite to each other, the first connector is located in an end portion in the first direction of the first housing, and
the first opening is located in an end portion in the second direction of the first housing.

* * * * *